US007439874B2

(12) United States Patent
Sotiriou

(10) Patent No.: US 7,439,874 B2
(45) Date of Patent: Oct. 21, 2008

(54) LOAD STATUS INDICATOR

(76) Inventor: George Sotiriou, Trident Building 42 Academy St., Patchogue, NY (US) 11772

( * ) Notice: Subject to any disclaimer, the term of this patent is extended or adjusted under 35 U.S.C. 154(b) by 114 days.

(21) Appl. No.: 11/456,961

(22) Filed: Jul. 12, 2006

(65) Prior Publication Data

US 2006/0244620 A1 Nov. 2, 2006

Related U.S. Application Data

(63) Continuation-in-part of application No. 11/107,449, filed on Apr. 15, 2005, now Pat. No. 7,315,255.

(51) Int. Cl.
*G08B 5/00* (2006.01)

(52) U.S. Cl. ..... 340/815.4; 340/635; 340/650; 340/657; 340/661; 340/664; 361/93.1; 361/88; 361/90

(58) Field of Classification Search ..... 340/815.4, 340/815.45, 635, 650, 657, 661, 664, 638; 361/93.1, 88, 90, 42, 79
See application file for complete search history.

(56) References Cited

U.S. PATENT DOCUMENTS 3,644,886 A 2/1972 Sabaroff
4,055,831 A 10/1977 Sakurai et al.
4,401,972 A 8/1983 Lupoli
4,447,806 A 5/1984 Gundel et al.
5,017,837 A * 5/1991 Hanna et al. ..... 315/136
5,070,301 A 12/1991 Schweitzer, Jr.
5,945,817 A * 8/1999 Nguyen ..... 323/273
5,986,557 A * 11/1999 Clarke ..... 340/638
6,075,448 A * 6/2000 Verkhovskiy ..... 340/657
6,828,915 B2 * 12/2004 Gottlieb ..... 340/653
7,123,156 B2 * 10/2006 Sadjadi ..... 340/638
7,315,255 B2 * 1/2008 Sotiriou ..... 340/815.4

* cited by examiner

*Primary Examiner*—Anh V La
(74) *Attorney, Agent, or Firm*—Shane A. Kennedy; Brake Hughes Bellermann LLP

(57) ABSTRACT

A load status indicator is disclosed for determining whether power is available to, and current is flowing through, a load. A first visual status indicator may light up when power is available to the load but current is not flowing through the load. A second visual status indicator may light up when power is available to the load and current is flowing through the load. A bi-color light-emitting diode may comprise the first and second visual status indicators. Transistors may be used to permit or prevent current from flowing through the visual status indicators. In some embodiments, a reed switch or a hall-effect sensor may be used to determine whether current is flowing through the load.

18 Claims, 28 Drawing Sheets

LOAD STATUS INDICATOR

This application is a continuation-in-part application, and claims priority from U.S. patent application Ser. No. 11/107,499, filed on Apr. 15, 2005, entitled "Load Status Indicator," the disclosure of which is hereby incorporated by reference.

BACKGROUND

The present application relates to electrical circuits for detecting and displaying the availability to, and use of power by, a load.

There are many settings in which it is valuable to know whether a control element, such as a solenoid, motor, pump, or compress, is running. For example, boats have a bilge pump to get rid of any water that may accumulate in the bilge. The pump is typically placed in the lowest part of the bilge and controlled by a float switch. It is difficult to know whether the pump is running or not. One solution to this problem has been the pilot light shown in FIG. 1. FIG. 1 shows a typical pilot light that indicates when the on/off switch is in the on position and power is available to the load. However, this pilot light does not show whether the float is in the active position or whether the pump is running.

FIG. 2 shows an improvement of the pilot light shown in FIG. 1, indicating when the float is active and power is available. However, this pilot light still does not show whether the pump is running. Further, the wires that connect the pilot light to the pump must be capable of carrying the breaker current rating, and the wires must be run to the pump, which can be a long distance. FIG. 3 uses a second pilot light to indicate whether power is available. The other characteristics are the same as for the pilot light of FIG. 2.

SUMMARY

An embodiment of the present application is a load status indicator comprising a first visual status indicator and a second visual status indicator that are not connected in series with a load. One of the visual status indicators is configured to indicate when power is available to the load but current is not flowing through the load. The other visual status indicator is configured to indicate when power is available to the load and current is flowing through the load.

Another embodiment of the present application is a load status indicator comprising a current-sensing component connected in series with a load and an indicating circuit connected in parallel with the series of load and current-sensing component. The indicating circuit comprises a first visual status indicator and a second visual status indicator. The first visual status indicator is configured to turn on when power is available to the load and indicating circuit, but a threshold current is not flowing through the current-sensing component, and to turn off when a threshold current is flowing through the current-sensing component. The second visual status indicator is configured to turn on when power is available to the load and indicating circuit, and a threshold current is flowing through the current-sensing component, and to turn off when a threshold current is not flowing through the current-sensing component.

Another embodiment of the present application is a load status indicator comprising a current-sensing component, a first transistor and a second transistor, and a first visual status indicator and a second visual status indicator. The load status indicator is configured to bias the first transistor to high impedance and to bias the second transistor to low impedance when a threshold current is not flowing through the current-sensing component, and to bias the first transistor to low impedance and to bias the second transistor to high impedance when a threshold current is flowing through the current-sensing component. Load status indicator may be further configured to cause the first visual status indicator to turn on when the first transistor is biased to low impedance, and to cause the second visual status indicator to turn on when the second transistor is biased to low impedance.

BRIEF DESCRIPTION OF THE DRAWINGS

The accompanying drawings illustrate several aspects of embodiments of the present invention. The drawings are for the purpose only of illustrating preferred modes of the invention, and are not to be construed as limiting the invention.

DETAILED DESCRIPTION

Figure 1:
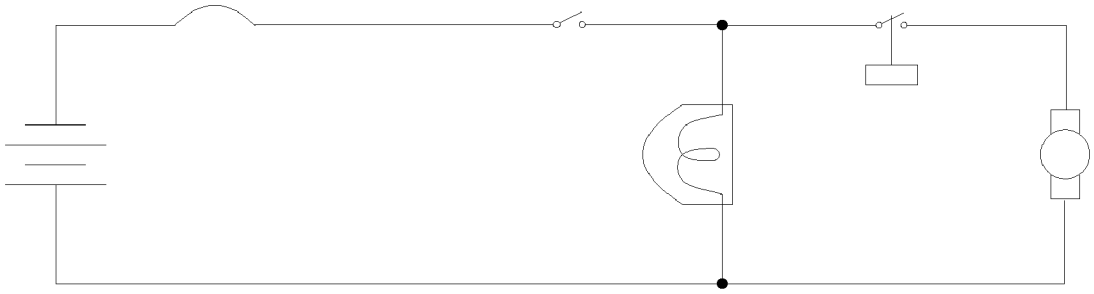
Figure 1 (Prior Art)
FIG. 1 shows a circuit diagram of a prior art pilot light.
Figure 2:
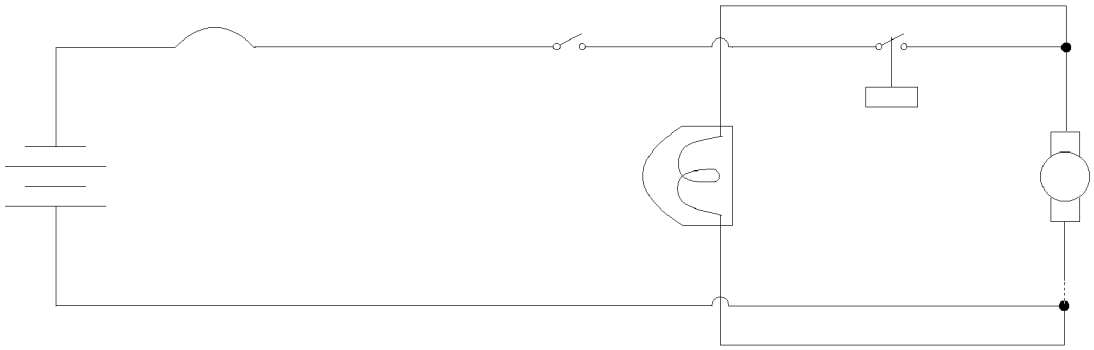
Figure 2 (Prior Art)
FIG. 2 shows a circuit diagram of an alternative prior art pilot light.
Figure 3:
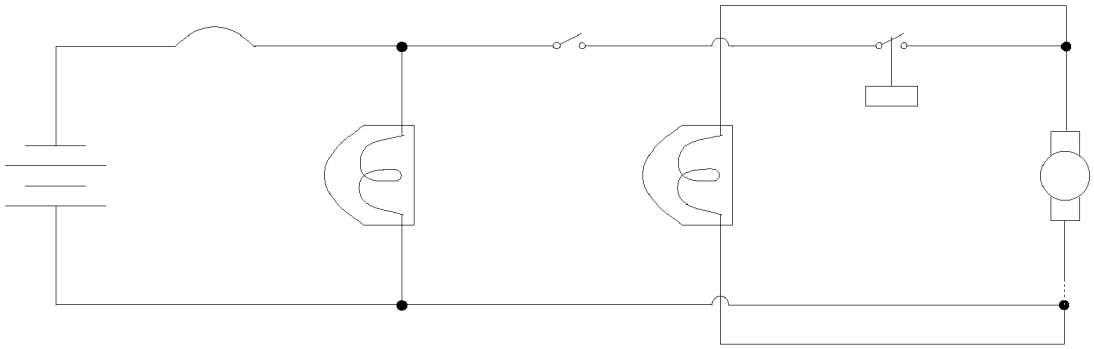
Figure 3 (Prior Art)
FIG. 3 shows a circuit diagram of another prior art pilot light.

In the following detailed description, reference is made to the accompanying drawings that form a part hereof, and in which is shown by way of illustration specific embodiments in which the invention may be practiced. These embodiments are described in sufficient detail to enable those skilled in the art to practice the invention, and it is to be understood that other embodiments may be utilized and that various changes may be made without departing from the spirit and scope of the present invention. The following detailed description is, therefore, not to be taken in a limiting sense.

Introduction

Some embodiments of the present application enable a bi-color light-emitting diode to indicate green when power is available to a load but the load is not drawing current, and red when power is available and the load is drawing current. Bi-color LEDs have two light-emitting diodes inside one lens package, usually red and green. They can come in 3-pin or 2-pin packages. The E231 and E292 models are 3-pin packages. The pins of the E292 are a red cathode, a green cathode, and a common anode. With the anode voltage greater than the red cathode voltage by 2.2 volts or more, the red light-emitting diode will light up; with the anode voltage greater than the green cathode voltage by 2.2 volts or more, the green light-emitting diode will light up. The pins of the E231 are a red anode, a green anode, and a common cathode. With the red anode voltage greater than the cathode voltage by 2.2 volts or more, the red light-emitting diode will light up; with the green anode voltage greater than the cathode voltage by 2.2 volts or more, the red light-emitting diode will light up.

Some embodiments described herein utilize a reed switch 12 to indicate when the load is drawing current, while other embodiments utilize a hall-effect linear sensor 100. The reed switch 12 has an advantage that it is inexpensive; however, the hall-effect linear sensor 100 has an advantage that it is easier to manufacture on a large scale. Components other than the reed switch 14 and coil 12 or hall-effect linear sensor 100 could be used and still have a switch open or close in response to whether current is flowing through the load 10. For example, a coil with a ferromagnetic core for concentrating the magnetic field of the coil combined with a giant magneto resistor would also cause a switch to be open when current is not flowing through the load 10 and closed when current is flowing through the load 10. Or, a shunt resistor with a high-side current-sense amplifier would also work to cause the switch to be responsive to whether current is flowing through the load 10.

In reed switch and the hall-effect linear sensor embodiments, the circuit may comprises a first bi-color LED 50, which may use model number E292, a first FET 60, and a second FET 70, which FETs may be N-channel DMOSs which switch from high to low impedance when the voltage difference between the gate 64, 74 and the source 66, 76, is approximately 3.5 volts. The FETs 60, 70 control whether current may flow through each LED 54, 56 in the first bi-color LED 50. In the reed switch embodiments, the first FET 60 and second FET 70 may be BS107P MOSFETs, whereas in the hall-effect linear sensor embodiments, the first FET 60 and second FET 70 may be BSS123LT1 power MOSFETs, which have a larger footprint. It is envisioned that other transistors or switching devices may be used instead of the transistors described herein.

Reed Switch Embodiments

The reed switch embodiments may draw approximately 250 milliwatts directly from the supply voltage of twelve volts DC; because the indicating circuit may be connected in parallel with the series of reed switch 12 and the load 10, the indicating circuit does not reduce the voltage or power available to the load 10. The power that is dissipated by the coil 12 is equal to the square of the current flowing through the load 10 times the resistance of the coil 12. With a coil resistance of 0.001 ohms and a maximum design current of thirty amperes, the power dissipated by the coil 12 is 0.9 watts. This dissipation of power by the coil 12 in series with the load 10 has a negligible effect on the load 10. In the embodiments shown in FIGS. 5, 7, 12, and 14, in which the indicating circuit has a power source that is independent of the load's power source, the indicating circuit is isolated from the load 10 by approximately one-thousand, two hundred volts root mean square.

In the reed switch embodiments shown in FIGS. 4-7 and 11-14, the load 10 to be monitored is connected in series with the coil 12. The coil 12 may be made of nine turns of number 16 AWG (American wire gauge) copper magnetic wire wound tightly around a single pole, single throw reed switch 14. Reed switches are generally inexpensive devices, and close in response to a magnetic field. They typically comprise a pair of flexible reeds made of a magnetic material sealed in a glass tube filled with inert gas. The reeds extend outside the tube in opposite directions, and overlap inside the tube, with a small gap of separation between them. Because of the gap, the reeds constitute an open circuit. Application of a magnetic field to the reed switch 14 causes both reeds to be magnetized. If the magnetic attracting force overcomes the resistive force caused by the elasticity of the reeds, the reeds come into contact, closing the circuit. The magnetic field can be generated by a magnet or a current flowing through a coil nearby, such as a coil wrapped around the glass tube. Once the magnetic field is removed, the reeds separate, and the circuit is opened.

The reed switch 14 may have a design sensitivity of between ten and fifteen IN (amp turns). The coil 12 may be wrapped around the reed switch 14. The dotted line in FIGS. 4-7 and 11-14 shows the connection between the coil 12 and the reed switch 14 caused by the influencing magnetic field.

With the coil 12 having nine turns of copper wire wrapped around the reed switch 14, the reed switch 14 will have a pickup threshold of 1.6 amperes running through the coil 12, and a dropout threshold of 1.4 amperes. The hysteresis of 0.2 amperes is a physical characteristic of a reed switch which ensures a stable transition between pickup and dropout. The threshold can be increased (from, for example, 1.6 amperes to 2.0 amperes) by reducing the number of turns of copper wire; conversely, the threshold can be decreased (from, for example, 1.6 amperes to 1.2 amperes) by increasing the number of turns of copper wire on the reed switch 14.

The power dissipated across the coil (which is equal to the current squared times the resistance) at full load affects the efficiency of the circuit. With nine turns of copper around the reed switch 14, the impedance of the coil 12 is 0.001 ohms, and the power dissipated across the coil 12, which is preferably the only component connected in series with the load 10, is just under one watt (approximately 0.3% of the load power) with a current of thirty amperes. Thus, the loss of power to the load 10 due to the load status indicator is small.

FIGS. 4-7 and 11-14 show embodiments using a reed switch 14 and coil 12 to monitor current flow through the load 10. In these embodiments, a voltage regulator 105 is configured as a constant current source and may provide a constant current to the load status indicator. With a pin 4 of the voltage regulator 105 connected to a first node 34 of the indicating circuit, a pin 3 of the voltage regulator 105 connected to a first end of a first resistor 41, which may provide sixty-two ohms of resistance in some embodiments, and a second end of the first resistor 41 connected to the first node 34, the voltage regulator 105 may provide twenty milliamperes of current to the indicating circuit. In some embodiments, this constant current supply causes the voltage drop across the series of a first diode 40, which may use model number 1N4148, the first bi-color light-emitting diode 50 and either the first or second FET 60, 70, to be approximately 3.5 volts, as long as the supply 20 has a voltage of at least approximately five volts relative to the negative supply, independent of whether or not current is flowing through the load 10 and coil 12. A zener diode could also be used for the first diode 40. A first pin of the voltage regulator 105 may be connected to the load supply 20, as in the embodiments shown in FIGS. 6 and 8, or may be connected to an independent DC supply 25, as in the embodiments shown in FIGS. 7 and 9.

The remaining components of the reed switch embodiment shown in FIGS. 4-7 may comprise a second resistor 42 having a resistance of 100 kiloohms, a third resistor 43 having a resistance of 100 kiloohms, and a first capacitor 91 having a capacitance of ten microfarads. The first capacitor 91, which may be made of tantalum, ensures the stability of the current flowing through the load status indicator, and also ensures clean switching of the FETs 60, 70, from high impedance to low impedance. Transistors other than field-effect transistors could be used, but would necessitate more components in the circuit, and hence greater expense. The resistors 41, 42, 43, and first capacitor 91, could also have different resistance and capacitance values and still achieve the switching effects of the invention.

The first diode 40, the second resistor 42, the third resistor 43, and the first capacitor 91 are each connected to a first node 34. The anode of the first diode 40 are connected to the first node 34 so that current may flow into the first diode 40 from the first node 34. The cathode of the first diode 40 may be connected to the anode 52 of the first bi-color LED 50 so that current flows into the first bi-color LED 50 from the first diode 40.

The red cathode 55 of the first bi-color LED 50 is connected to the first drain 62 of the first FET 60; if the first gate 64 of the first FET 60 is biased high, approximately 3.5 volts, then the first FET 60 may switch to low impedance, allowing current to flow from the red cathode 55 of the first bi-color LED 50 into the first drain 62 and out of the first source 66 to the negative supply 5. The green cathode 57 of the first bi-color LED 50 is connected to the second drain 72 of the second FET 70, to the first gate 64 of the first FET 60, and to the end of the second resistor 42 opposite from the first node 34; if the second gate 74 of the second FET 70 is biased high, approximately 3.5 volts, then the second FET 70 may switch to low impedance, allowing current to flow from the green cathode 57 of the first bi-color LED 50 into the second drain 72 of the second FET 70 and out of the second source 76 to negative supply 5.

As discussed above, the first end of the second resistor 42 is connected to the first node 34; the second end of the second resistor 42 is connected to the green cathode 57 of the first bi-color light-emitting diode 50, to the second drain 72 of the second FET 70, and to the first gate 64 of the first FET 60. The first end of the third resistor 43 is connected to the first node 34; the second end of the third resistor 43 is connected to the second gate 74 of the second FET 70, and to the first end of the reed switch 14. The first end of the reed switch 14 is connected to the second end of the third resistor 43 and to the second gate 74 of the second FET 70; the second end of the reed switch 14 is connected to the first source 66 of the first FET 60 and to the second end of the first capacitor 91. The first end of the first capacitor 91 is connected to the first node 34; the second end of the first capacitor 91 is connected to the second end of the reed switch 14 and to the first source 66 of the first FET 60.

Figure 4:
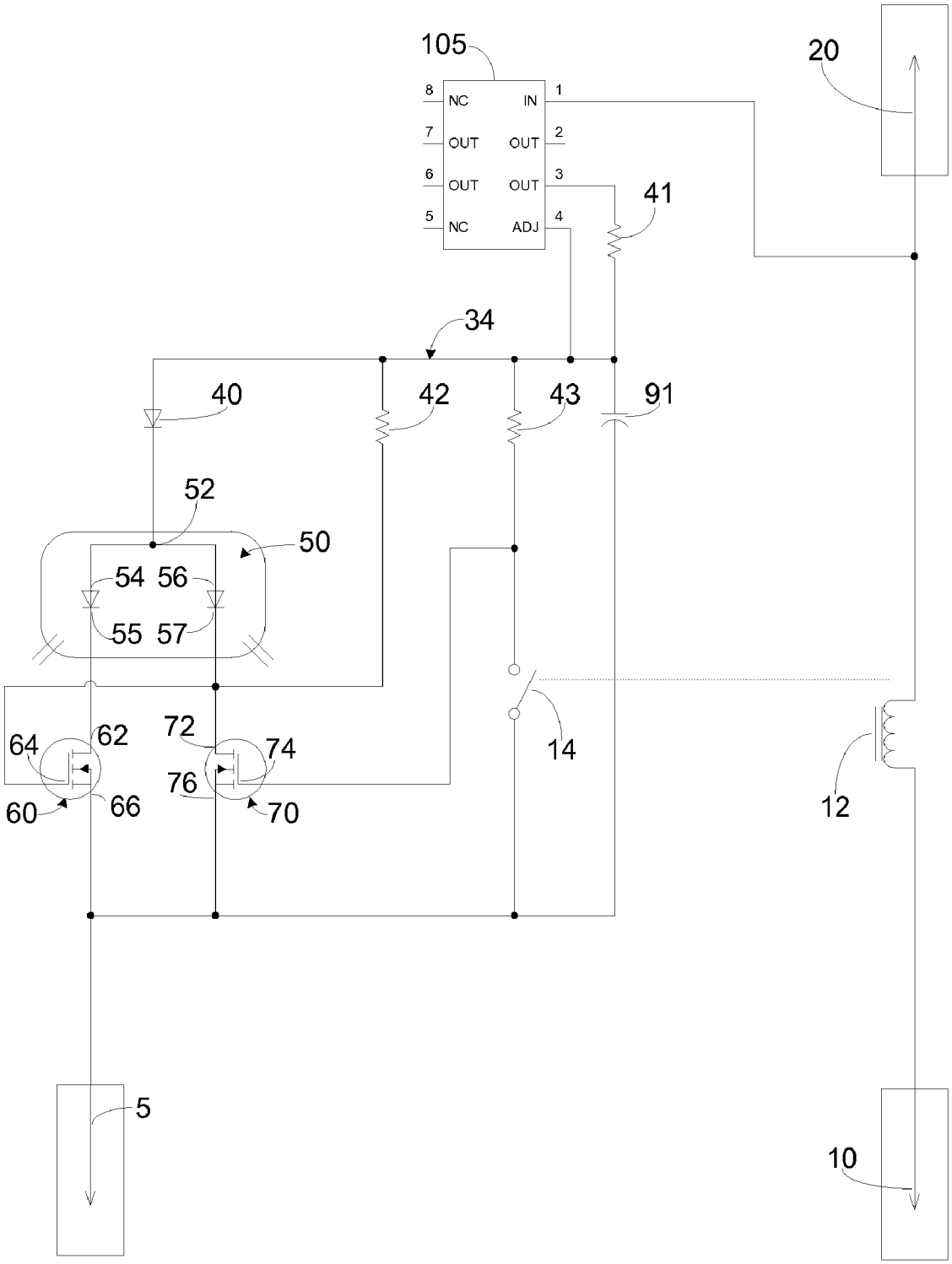
FIG. 4 shows a circuit diagram of an embodiment of a load status indicator utilizing a reed switch, three wires, operating on DC, with no remote indicator, and non-isolated.
Figure 5:
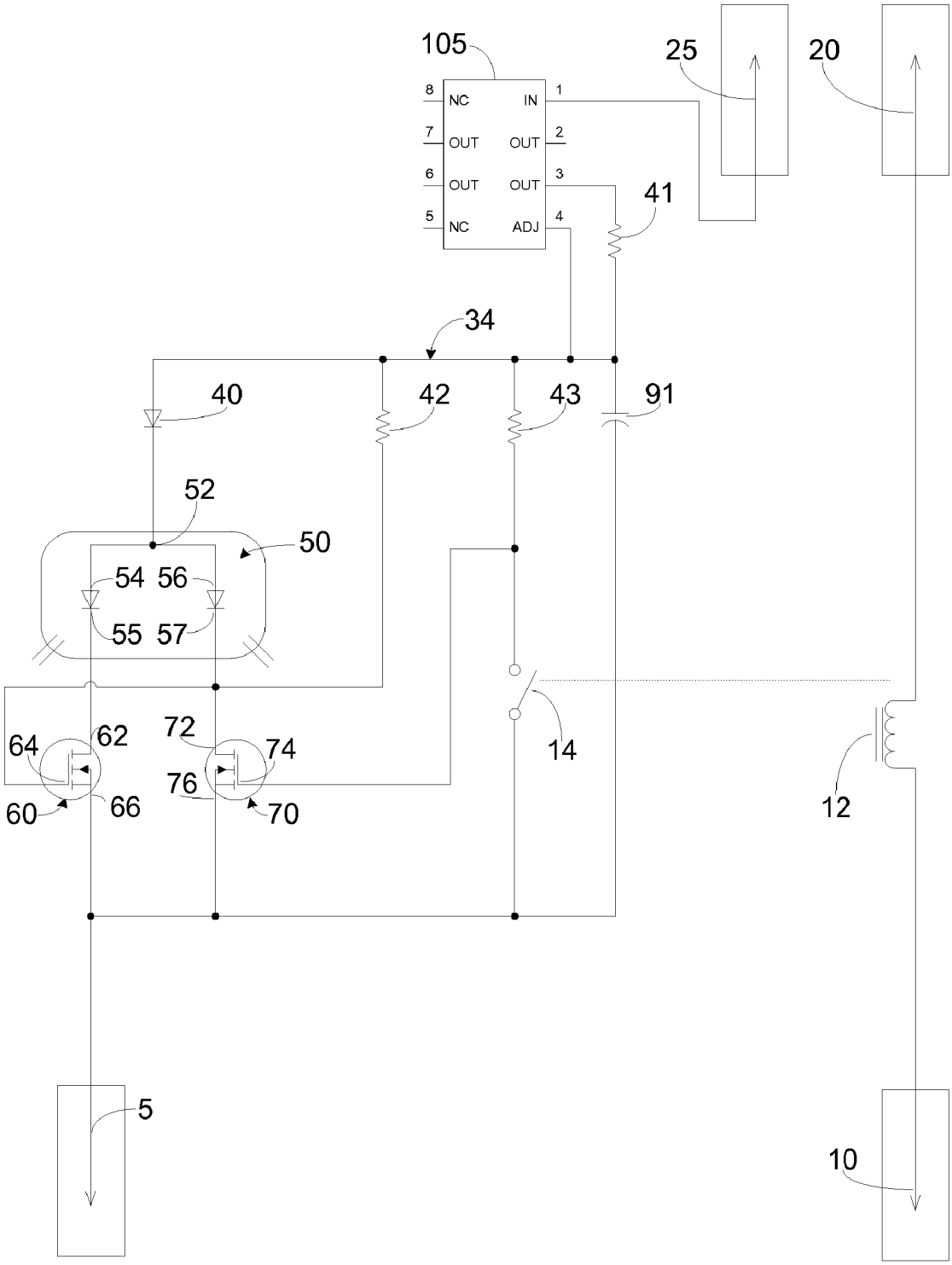
FIG. 5 shows a circuit diagram of an embodiment of a load status indicator utilizing a reed switch, four wires, operating on DC, with no remote indicator, and 1,200 volts root-mean-square isolation.
Figure 6:
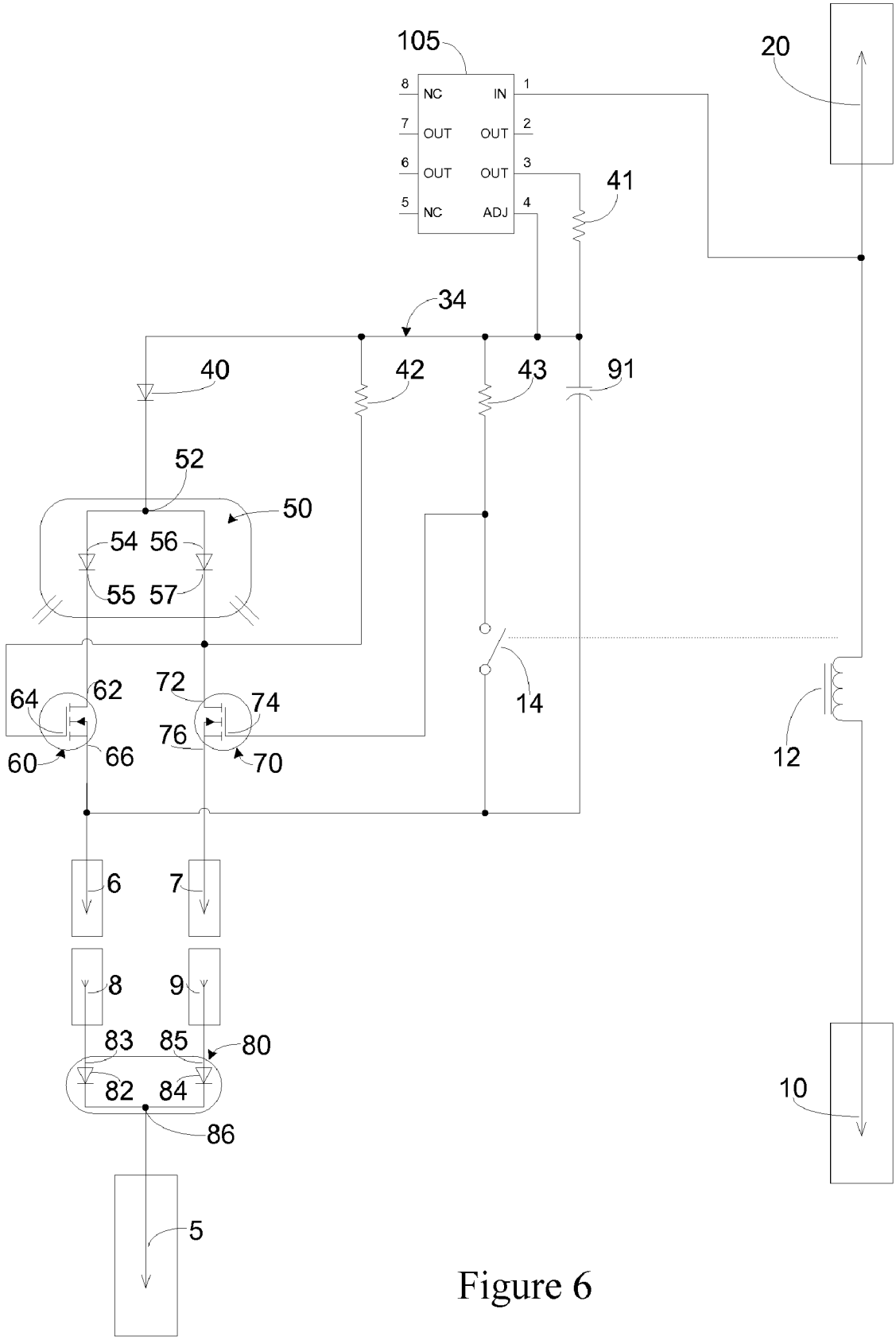
FIG. 6 shows a circuit diagram of an embodiment of a load status indicator utilizing a reed switch, four wires, operating on DC, with a remote indicator, and non-isolated.
Figure 7:
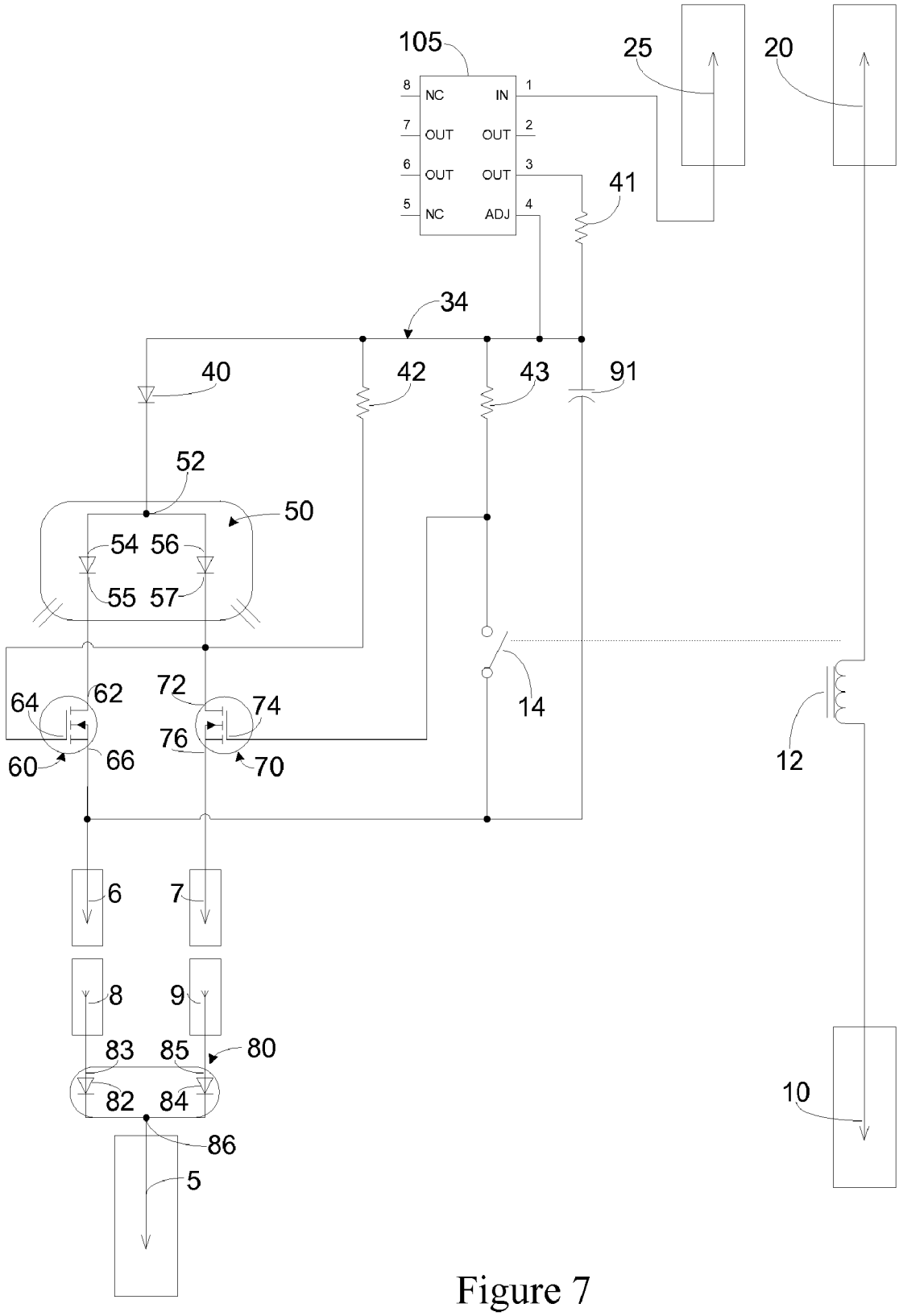
FIG. 7 shows a circuit diagram of an embodiment of a load status indicator utilizing a reed switch, five wires, operating on DC, with a remote indicator, and 1,200 volts root mean square isolation.

The first source 66 of the first FET 60 may be connected to a negative supply 5, as shown in FIGS. 4 and 5, or may be connected to a red transmitter 6 which remotely communicates with a red receiver 8, which controls a red anode 83 of a second bi-color LED 80, which may utilize model E231 in some embodiments, as shown in FIGS. 6 and 7. The second source 76 of the second FET 70 may also be connected to a negative supply 5, as shown in FIGS. 4 and 5, or may be connected to a green transmitter 7 which remotely communicates with a green receiver 9, which controls a green anode 85 of the second bi-color LED 80, as shown in FIG. 6 and 7. With these remote connections, the red LED 82 of the second bi-color LED 80 may light up when the red LED 54 of the first bi-color LED 50 lights up, and the green LED 84 of the second bi-color LED 80 may light up when the green LED 56 of the first bi-color LED 50 lights up. This allows the status of the load 10 to be monitored from a location remote from the load 10.

When the supply 20 is providing voltage, but no current is flowing through the load 10, there will be no current flowing through the coil 12. In this circumstance, the reed switch 14 acts as an open circuit. The second gate 74 of the second FET 70 may be biased high through the third resistor 43, approximately 3.5 volts, switching the second FET 70 to low impedance. This allows current to flow out of the green cathode 57 of the first bi-color LED 50 and through the second FET 70. Because the first gate 64 of the first FET 60 is connected to the second drain 72 of the second FET 70, the first gate 64 may be biased low, approximately zero volts. This may cause the second resistor 42 to effectively become an open circuit. Because the first gate 64 is biased low, the first FET 60 has high impedance, and no current may flow through the first FET 60 or out of the red cathode 55 of the first bi-color LED 50. Therefore, the first and second bi-color LEDs 50, 80 may light up green but not red.

When the supply 20 is providing voltage and current is flowing through the load 10, then in all likelihood the load 10, such as a motor, is operating. With the minimum threshold current, 1.6 amperes in the preferred embodiment, flowing through the load 10 and the coil 12, the reed switch 14 may close, creating a short circuit across the reed switch 14. Because the second gate 74 will be connected to the first source 66, the second gate 74 may be biased low, approximately zero volts. Because the second gate 74 may be biased low, the impedance of the second FET 70 may be switched to high, preventing current from flowing out of the green cathode 57 of the first bi-color LED 50 and through the second FET 70. The third resistor 43 may effectively act as an open circuit because the reed switch 14 may have turned the second FET 70 off. The first gate 64 of the first FET 60 may be biased high, approximately 3.5 volts. This may switch the impedance of the first FET 60 to low, allowing current to flow out of the red cathode 55 of the first LED 50 and through the first FET 60. The may cause the first and second bi-color LEDs 50, 80, to light up red but not green.

AC Supply Circuit

Figure 8:
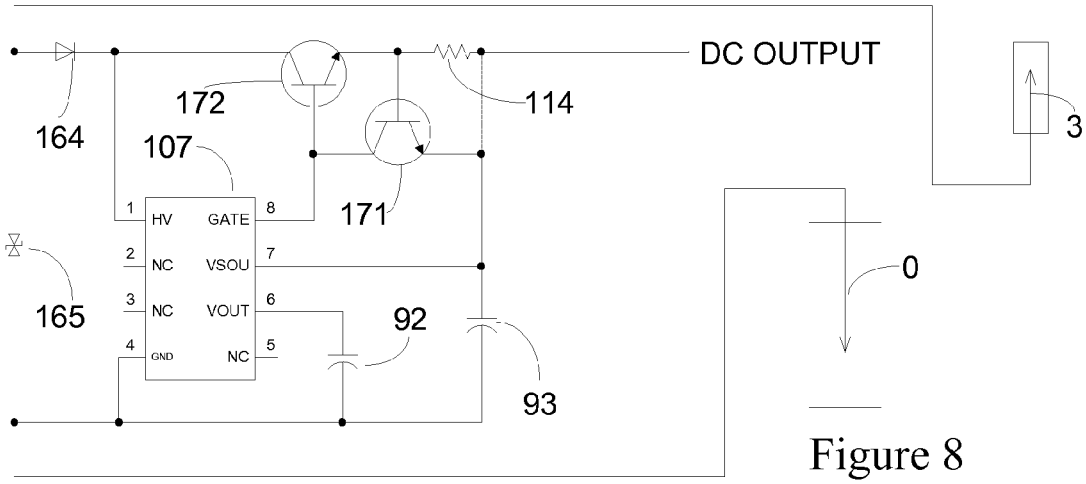
FIG. 8 shows a circuit diagram of an AC supply circuit for converting an AC power supply to DC power used in some embodiments of the load status indicator.
Figure 9:
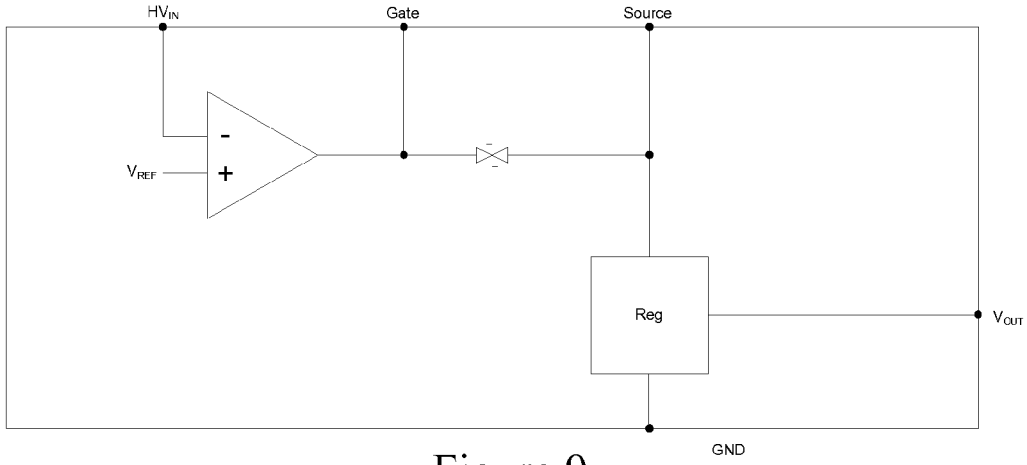
FIG. 9 shows a block diagram of an integrated circuit used in the AC power supply shown in FIG. 8.

The load status indicator may also operate on an AC supply. A circuit for converting an AC supply into a DC is shown in FIG. 8. The circuit may use an off-line regulator 107, which in some embodiments may be a Supertex SR036. A functional block diagram of the SR036 used as the off-line regulator 107 is shown in FIG. 9. A pin 1, HV, of the off-line regulator 107 may be connected to a cathode of a second diode 164 (which may act as a half-wave rectifier to convert AC to DC) and to a collector of a second bipolar junction transistor 172; in some embodiments the second bipolar junction transistor 172 may be a Supertext GN2470 insulated gate bipolar transistor. An anode of the second diode 164 is connected to an AC input 3 and to a first end of a surge protector 165. The surge protector 165 is connected to a pin 4, GND, of the off-line regulator 107, to a second end of the second capacitor 92, a second end of a third capacitor 93, and to neutral 0. The surge protector 165 may eliminate destructive transients from the AC input 3. A pin 6, VOUT, is connected to a first end of the second capacitor 92. A pin 7, VSOU, of the off-line regulator 107 is connected to a first end of the third capacitor 93, to an emitter of a first bipolar junction transistor 171 (which may be an npn bipolar junction transistor), to a second end of a fourth resistor 114, and to a DC output. A pin 8, GATE, of the off-line regulator 107 is connected to a collector of the first bipolar junction transistor 171 and to a base of the second bipolar junction transistor 172. The collector of the second bipolar junction transistor 172 is connected to the cathode of the second diode 164 and to the first pin HV of the off-line regulator 107. A collector of the second bipolar junction transistor 172 is connected to the pin 8, GATE, of the off-line regulator 107 and to the collector of the first bipolar junction transistor 171. An emitter of the second bipolar junction transistor 172 is connected to a base of the first bipolar junction transistor 171 and to a first end of the fourth resistor 114.

Figure 10:
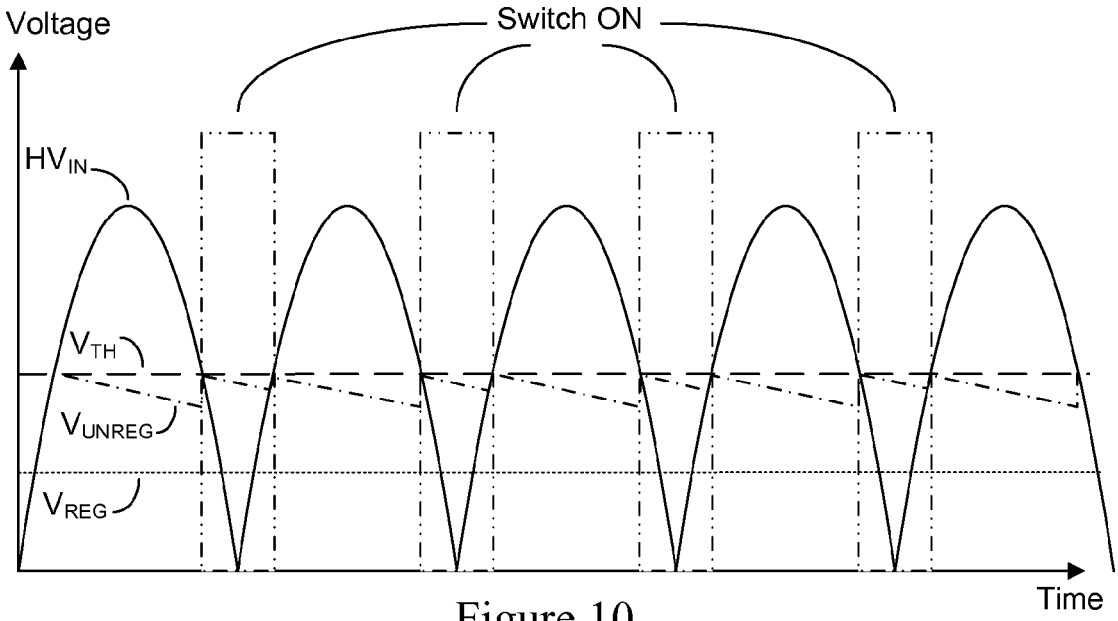
FIG. 10 shows a typical waveform of the integrated circuit shown in FIG. 9.

The off-line regulator 107 may operate by controlling a conduction angle of the second bipolar junction transistor 172, as shown in FIG. 10. When the rectified AC supply voltage, $HV_{IN}$ (shown by the solid curves), is below the $V_{TH}$ threshold voltage (shown by the dashed line), the pass transistor of the off-line regulator 107 may turn on. The time periods in which the pass transistor may be turned on are represented by the vertical rectangles. The pass transistor may turn off when the AC supply voltage $HV_{IN}$ is above the $V_{TH}$ threshold. The output voltage, $V_{UNREG}$ (shown by the alternating dashed and dotted lines), may decay during the periods when the switch is off and the rectified AC supply voltage $HV_{IN}$ is above the $V_{TH}$ threshold voltage. The rate of decay may be determined by the value of the second capacitor 92 connected to the pin 6, VOUT, of the off-line regulator 107. Power dissipation through the off-line regulator 107 may be minimized with the off-line regulator 107 conducting only with low voltages across it.

In the AC supply circuit shown in FIG. 8, the neutral 0 is in common with the DC output, the efficiency is greater than twenty-five percent, and the components are surface-mounted on a small enclosure. The off-line regulator 107 acts as a conduction angle regulator to control the second bipolar junction transistor 171. The second bipolar junction transistor 172 controls the charging of the third capacitor 93, establishing a DC operating voltage of fifteen volts DC and a current of twenty milliamperes at the DC OUTPUT when the AC input 3 has a peak voltage of twenty-four volts. The second capacitor 92 acts as a bypass capacitor to ensure stable operation of the circuit. The first bipolar junction transistor 171 and fourth resistor 114 may form a protective circuit that will clamp the second bipolar junction transistor 172 from conducting if the current through the second bipolar junction transistor 172 exceeds three amperes, preventing the second bipolar junction transistor 172 from overheating.

The AC supply circuit shown in FIG. 8 may operate on a wide range of AC input 3 voltages between twenty-four volts AC and two hundred seventy volts AC, with a frequency range between forty hertz and seventy hertz, allowing for operation in both the United States and Europe. Twenty-four volts AC is a very common control voltage in heating, air conditioning, and industrial controls. The AC supply circuit may also act as a voltage follower if a DC voltage is applied at the AC input 3, allowing the load status indicator to operate in either AC or DC when configured with the AC supply circuit. This is possible for the embodiments of the load status indicator shown in FIGS. 11 and 12.

Application of AC Supply Circuit to Reed Switch Embodiments

Figure 11:
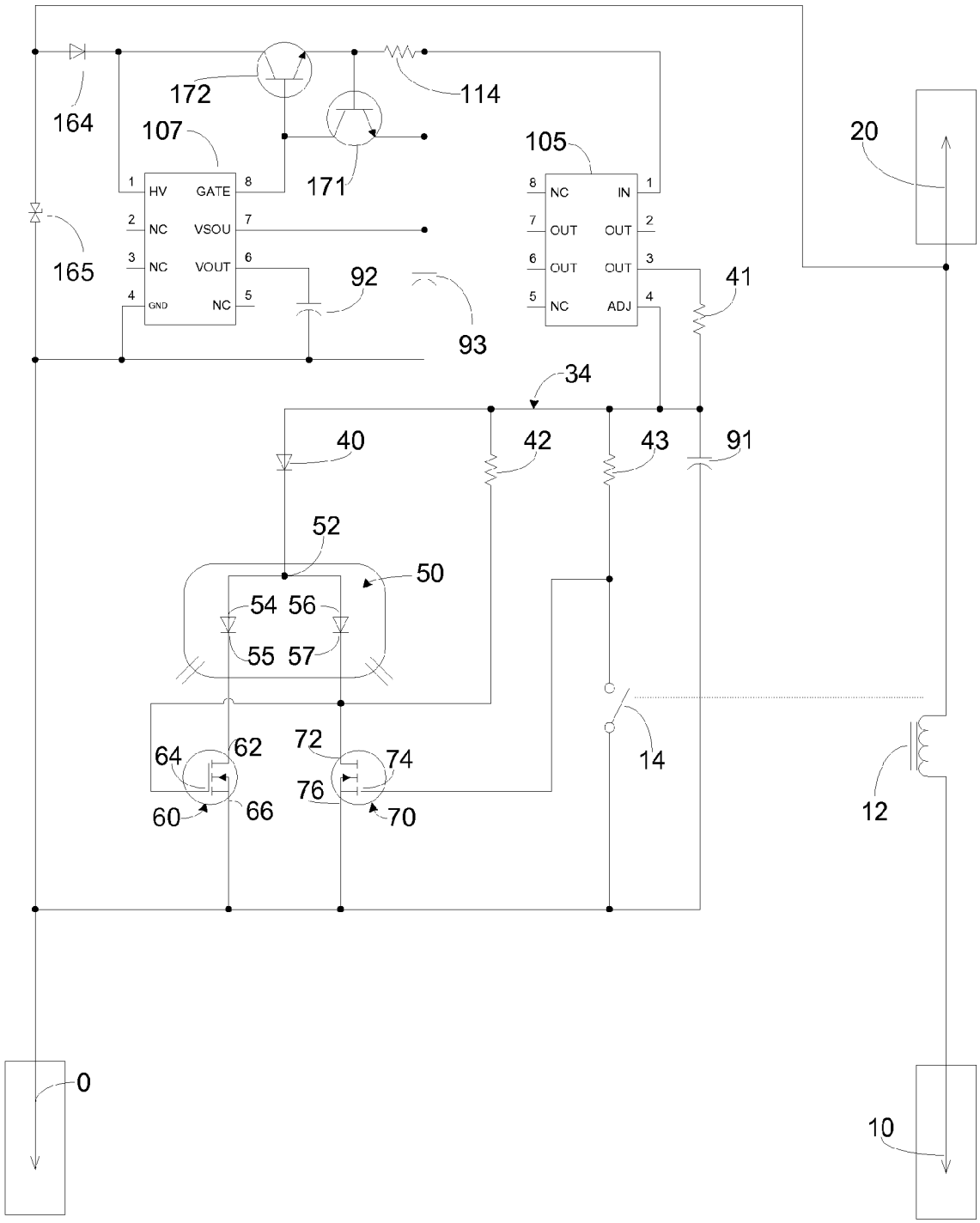
FIG. 11 shows a circuit diagram of an embodiment of a load status indicator utilizing a reed switch, three wires, operating on either AC or DC, with no remote indicator, and non-isolated.
Figure 12:
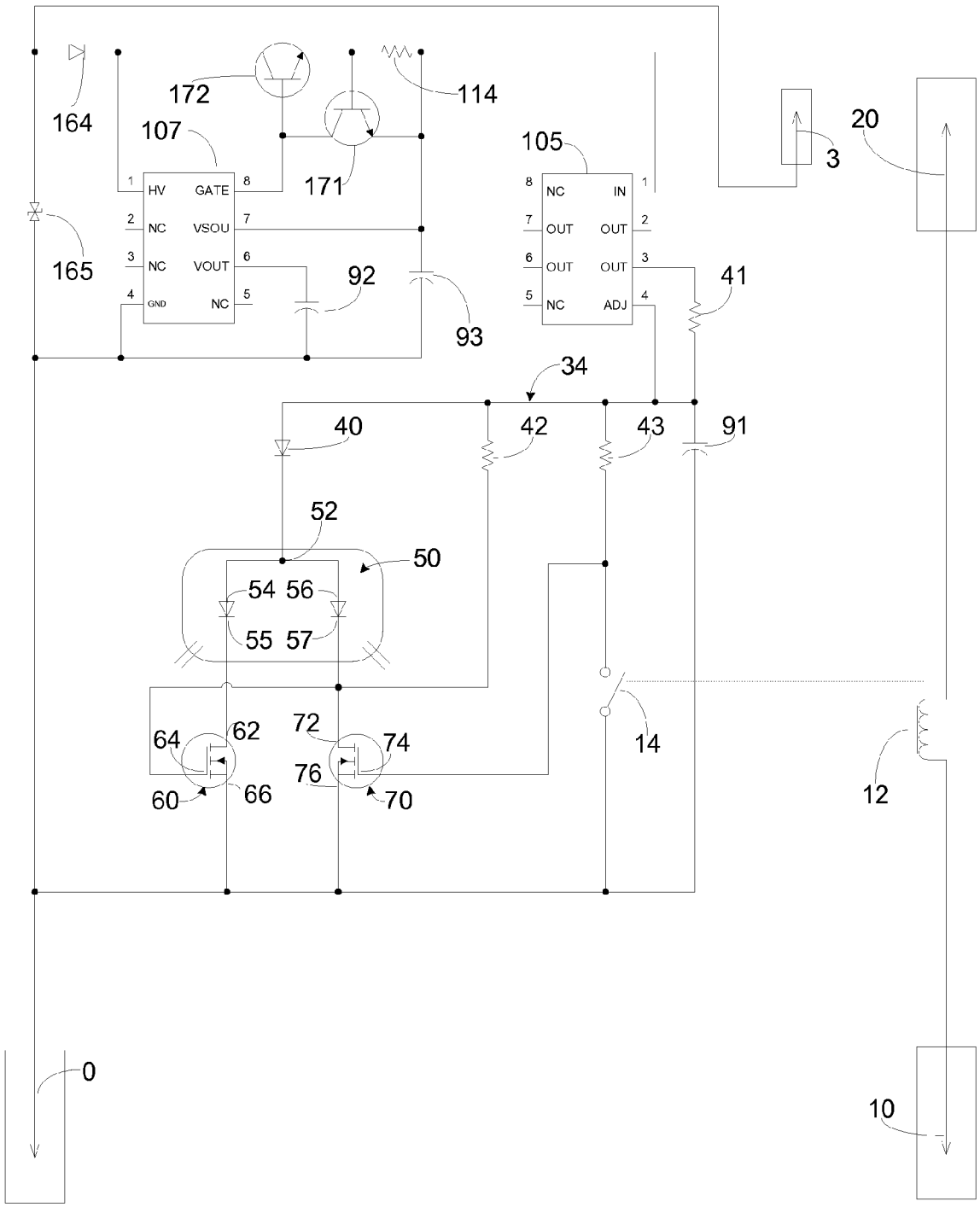
FIG. 12 shows a circuit diagram of an embodiment of a load status indicator utilizing a reed switch, three wires, operating on either AC or DC, with no remote indicator, and 1,200 volts root mean square isolation.
Figure 13:
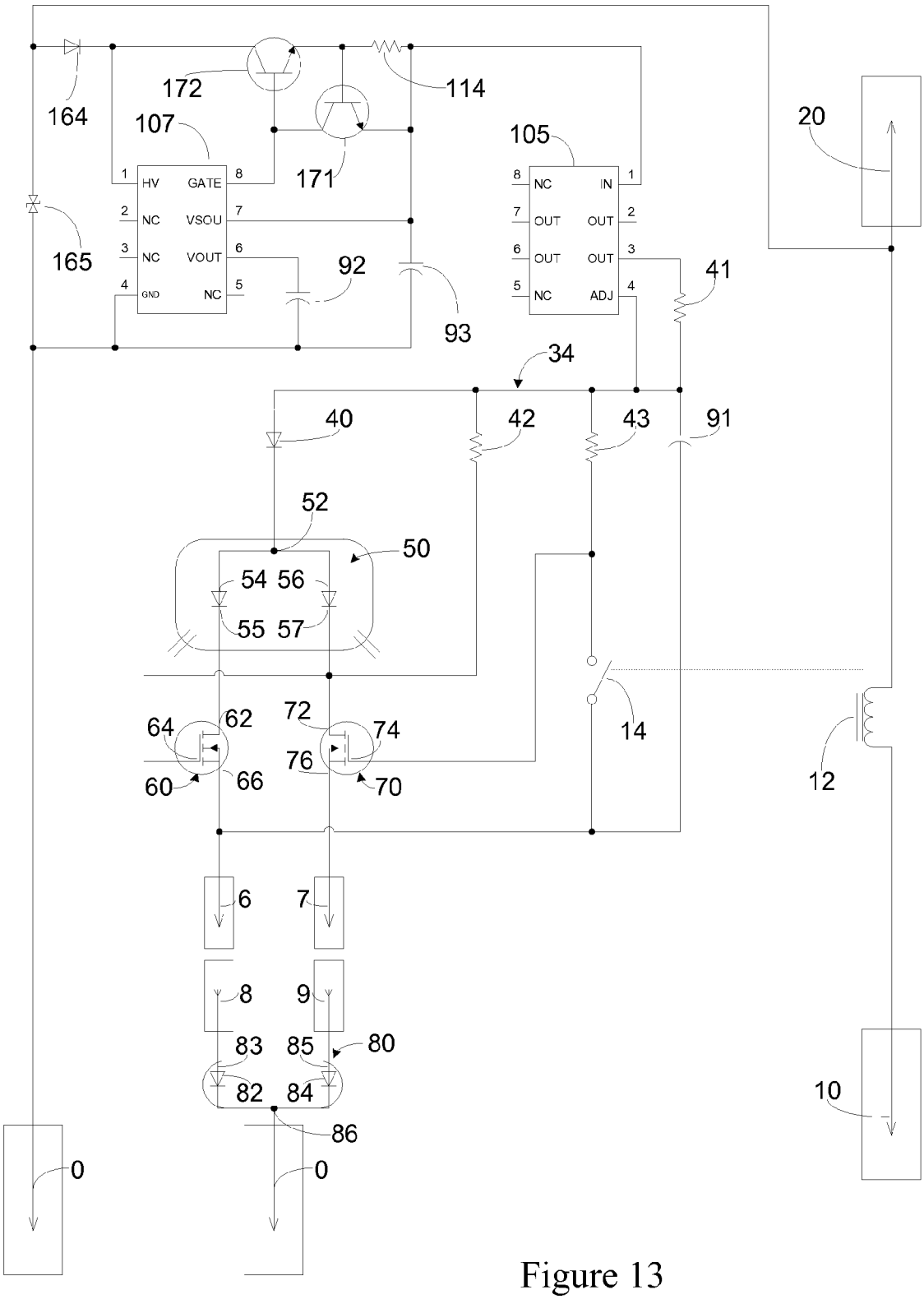
FIG. 13 shows a circuit diagram of an embodiment of a load status indicator utilizing a reed switch, five wires, operating on AC, with a remote indicator, and non-isolated.
Figure 14:
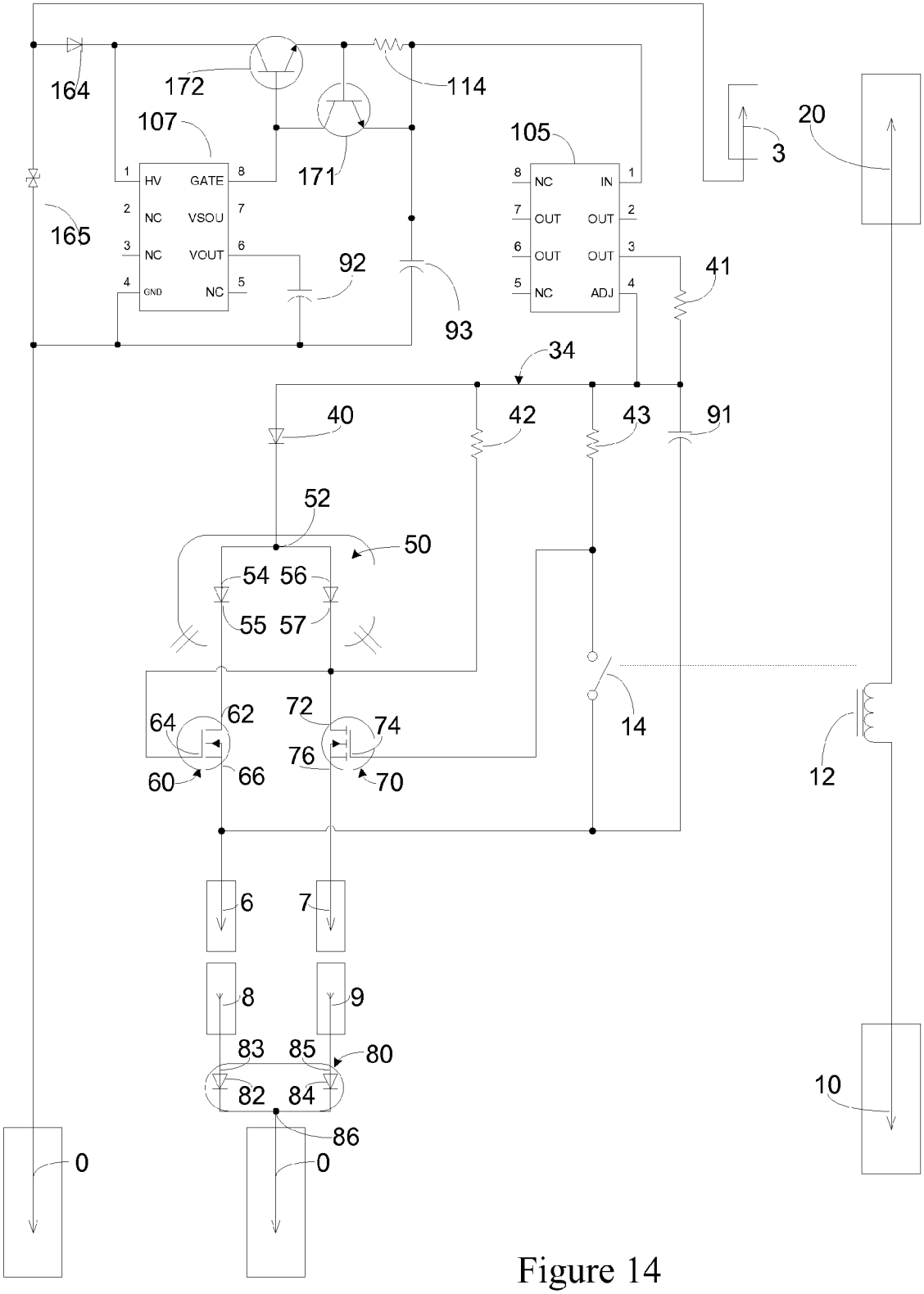
FIG. 14 shows a circuit diagram of an embodiment of a load status indicator utilizing a reed switch, six wires, operating on AC, with a remote indicator, and 1,200 volts root mean square isolation.

FIGS. 11-14 show the application of the AC supply circuit shown in FIG. 8 to the reed switch embodiments shown in FIGS. 4-7. FIG. 11 shows the AC supply circuit of FIG. 8 inserted into the load status indicator circuit shown in FIG. 4, with the DC OUTPUT of the AC supply circuit shown in FIG. 8 connected to the pin 1, IN, of the voltage regulator 105, and the anode of the second diode 164 and the first end of the surge protector 165 connected to the supply 20. FIG. 12 shows the AC supply circuit of FIG. 8 inserted into the load status indicator circuit shown in FIG. 5, with the DC OUTPUT of the AC supply circuit connected to the pin 1 of the voltage regulator 105, and the anode of the second diode 164 and the first end of the surge protector 165 connected to an AC input 3. FIG. 13 shows the AC supply circuit of FIG. 8 inserted into the load status indicator circuit shown in FIG. 6, with the DC OUTPUT of FIG. 8 connected to the pin 1 of the voltage regulator 105, and the anode of the second diode 164 and the first end of the surge protector 165 connected to the supply 20. FIG. 14 shows the AC supply circuit of FIG. 8 inserted into the load status indicator circuit shown in FIG. 7, with the DC OUTPUT of FIG. 8 connected to the pin 1 of the voltage regulator 105, and the anode of the second diode 164 and the first end of the surge protector 165 connected to an AC input 3.

In the embodiments shown in FIGS. 11 and 12, which do not utilize remote indicators, the second end of the surge protector 165, pin 4 of the off-line regulator 107, the second end of the second capacitor 92, and the second end of the third capacitor 93 are connected to neutral 0, to the first source 66 of the first FET 60, to the second source 76 of the second FET 70, and to the first end of the tenth resistor 110. In the embodiments shown in FIGS. 13 and 14, which do utilize remote indicators, the second end of the surge protector 165, pin 4 of the off-line regulator 107, the second end of the second capacitor 92, and the second end of the third capacitor 93 are connected only to the neutral 0. The remote indicators of the embodiments shown in FIGS. 13 and 14 are connected as in the embodiments shown in FIGS. 6 and 7.

Hall-Effect Sensor Embodiments

The load status indicator may utilize a hall-effect sensor 100 instead of a reed switch 14. An advantage of using the hall-effect sensor 100 is that the circuit becomes easier to manufacture in large quantities. Another advantage of using the hall-effect sensor 100 is that the threshold current for indicating that the load 10 is functioning can be determined by the ratio of two resistors, instead of being limited by the ratio of turns of wire around the reed switch 14. The minimum operating current flowing through the load 10 that the load status indicator using the hall-effect sensor 100 can detect is approximately one hundred milliamperes plus or minus one percent, compared to 1.8 amperes plus or minus ten percent for the reed switch design.

Figure 15:
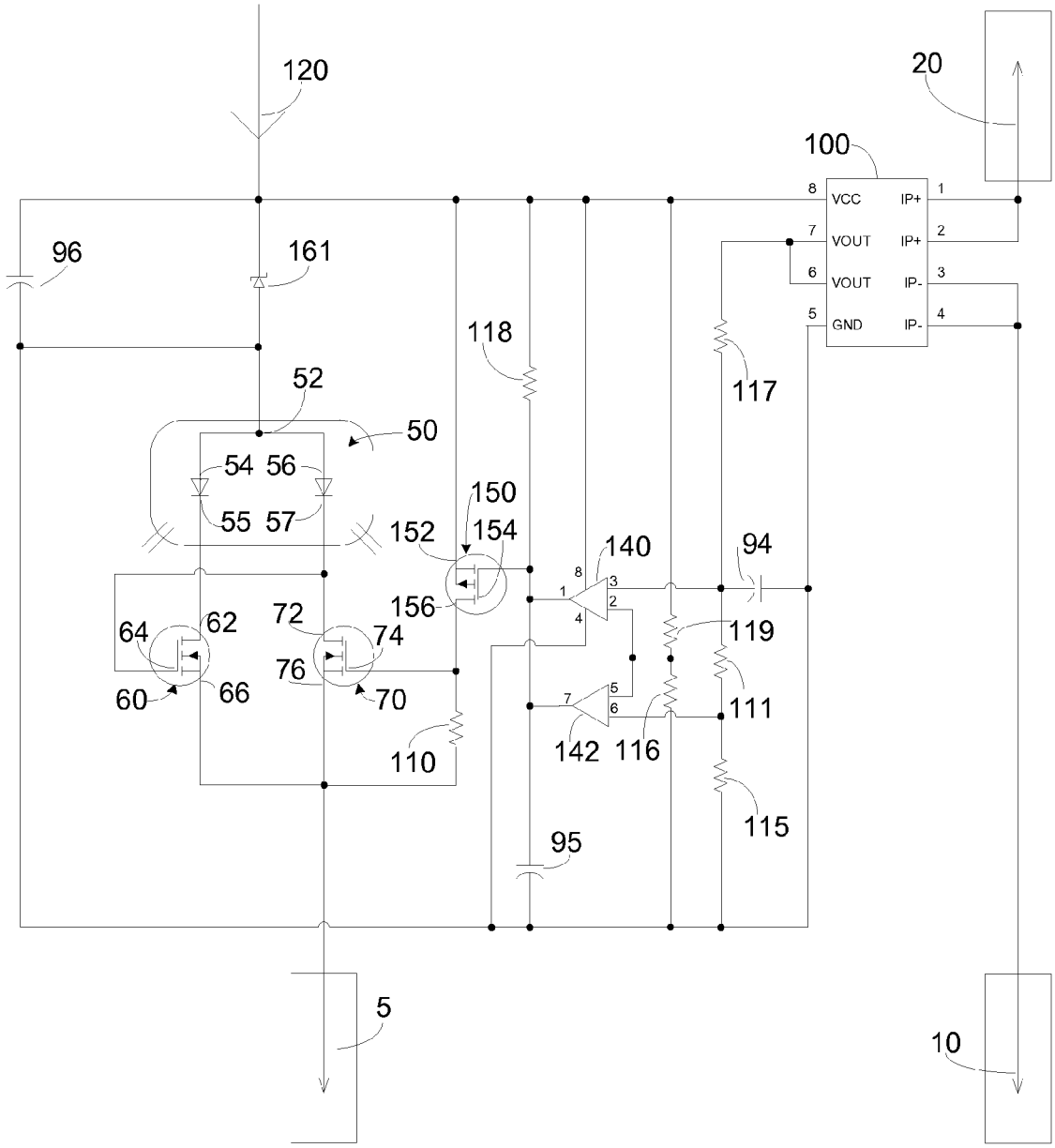
FIG. 15 shows a circuit diagram of an embodiment of a load status indicator utilizing a hall-effect linear sensor instead of a reed switch.

FIG. 15 shows an embodiment of the hall-effect load status indicator with an independent current source 120, which may supply approximately twenty milliamperes of current to the indicating circuit, in place of the actual circuitry used in various embodiments.

The hall-effect load status indicator may comprise a hall-effect sensor 100 which, in some embodiments, may be a fully integrated, hall-effect based linear current sensor with voltage isolation and a low-resistance current conductor manufactured by Allegro MicroSystems as part number ACS704ELC-005. This device comprises a precision, low-offset linear hall-effect sensor circuit with a copper conduction path located near the surface of the die. When an applied current flows through the copper conduction path, the applied current generates a magnetic field which is sensed by the hall sensor circuit and is converted into a voltage of magnitude proportional to the applied current. The accuracy of the device is optimized by the close proximity of the magnetic signal to the hall transducer. A low-offset, copper-stabilized BiCMOS hall IC, which is programmed during production of the device, provides for the precise, proportional voltage. When increasing current flows from pins 1 and 2 to pins 3 and 4, the primary path for current sensing, the output of the device, measured as the voltage potential at pins 6, VOUT, and 7, VOUT, has a positive slope as a function of the current, the slope being greater than half the voltage of pin 8, VCC (supply voltage). The internal resistance of the conductive path from pins 1 and 2 to pins 3 and 4 is typically 1.5 milliohms, which provides for low power loss. The thickness of the copper conduction path allows the device to function at up to three times overcurrent conditions. The terminals of the conductive path, pins 1, 2, 3, and 4, are electrically isolated from the sensor leads or output pins 5, 6, 7, and 8. Thus, in the embodiments shown in FIGS. 17, 19, 21, and 23, in which the hall-effect sensor 100 has a power source independent of the load's supply 20, the indicating circuit of the load status indicator is isolated from the load 10 by approximately eight hundred volts root mean square.

Pins 1, IP+, and 2, TIP+, of the hall-effect sensor 100 are connected to each other and to the supply 20. Pins 3, TIP−, and 4, IP−, of the hall-effect sensor 100 are connected to each other and to the load 10. Pin 5, GND, of the hall-effect sensor 100 is connected to a first end of a fourth capacitor 94, having a capacitance of 0.1 microFarads, to a first end of a fifth resistor 115, having a resistance of 2.15 kiloohms, to a first end of a sixth resistor 116, having a resistance of one kiloohm, to a first end of a fifth capacitor 95, having a capacitance of 0.1 microFarads, to a pin 4 of a first comparator 140, negative voltage, to a first end of a sixth capacitor 96, having a capacitance of ten microfarads up to 6.3 volts, to an anode of a 5.1 volt zener diode 161, and to the anode 52 of the first bi-color LED 50. Pins 6, VOUT, and 7, VOUT, are connected to each other and to a first end of a seventh resistor 117, having a resistance of ten kiloohms. Pin 8, VCC, of the hall-effect sensor 100 is connected to the independent current source 120, to a second end of the sixth capacitor 96, to a cathode of the zener diode 161, to a source 152 of a p-channel MOSFET 150, to a first end of an eighth resistor 118, which may have a resistance of one hundred kiloohms, to a pin 8 of the first comparator 140, positive voltage, and to a first end of a ninth resistor 119, which may have a resistance of ten kiloohms.

The fourth capacitor 94 and fifth capacitor 95 may serve as bypass capacitors, enabling current sensing. The sixth capacitor 96 may serve as a filter capacitor. The zener diode 161 may set the operating voltage for the hall-effect sensor 100 and the dual differential comparator, the dual differential comparator comprising the first comparator 140 and second comparator 142.

The independent current source 120 is connected to the second end of the sixth capacitor 96, to the cathode of the zener diode 161, to the source 152 of the p-channel MOSFET 150, to the first end of the eighth resistor 118, to pin 8 of the first comparator 140, and to the first end of the ninth resistor 119. The first end of the sixth capacitor 96 and the anode of the zener diode 161 are connected to each other, and to the anode 52 of the first bi-color LED 52, to pin 4 of the first comparator 140, to the first end of the fifth capacitor 95, to the first end of the sixth resistor 116, to the first end of the fifth resistor 115, to the first end of the fourth capacitor 94, and to pin 5 of the hall-effect sensor 100.

The red cathode 55 of the first bi-color LED 50 is connected to the first drain 62 of the first FET 60. The green cathode 57 of the first bi-color LED 50 is connected to the second drain 72 of the second FET 70 and to the first gate 64 of the first FET. The first gate 64 of the first FET 60 is connected to the green cathode 67 of the first bi-color LED 50 and to the second drain 72 of the second FET 70. The first drain 66 of the first FET 60 and the second drain 76 of the second FET are connected to each other, and to a first end of a tenth resistor 110, which may have a resistance of one hundred kiloohms, and to a negative supply 5. The second gate 74 of the second FET 70 is connected to a second end of the tenth resistor 110, and to a drain 156 of the p-channel MOSFET 150. The gate 154 of the p-channel MOSFET 150 is connected to a second end of the fifth capacitor, to a pin 1, output, of the first comparator 140, to a pin 7, output, of a second comparator 142, and to a second end of the eighth resistor 118. The source 152 of the p-channel MOSFET 150 is connected to pin 8 of the hall-effect sensor 100, and to the other components to which pin 8 of the hall-effect sensor 100 is connected.

Pin 3 of the first comparator 140, noninverting input, is connected to a second end of the seventh resistor 117, to a second end of the fourth capacitor 94, and to a first end of an eleventh resistor 111, which may have a resistance of two hundred and forty ohms. Pin 2 of the first comparator 140, inverting input, is connected to pin 5 of the second comparator 142, non inverting input, and to a second end of the ninth resistor 119 and to a second end of the sixth resistor 116. Pin 7 of the second comparator 142 is connected to the gate 154 of the p-channel MOSFET 150, to the second end of the eighth resistor 118, to pin 1 of the first comparator 140, and to the second end of the fifth capacitor 95. Pin 5 of the second comparator 142 is connected to pin 2 of the first comparator 140, to the second end of the ninth resistor 119, and to the second end of the sixth resistor 116. Pin 6, inverting input, of the second comparator 142, is connected to a second end of the eleventh resistor 111 and to a second end of the fifth resistor 115.

The first comparator 140 and second comparator 142 be comprised by an integrated circuit that is a dual differential comparator configured as a window detector, enabling both AC current and bidirectional DC current sensing. The first comparator 140 may detect a positive limit of the current, and the second comparator 142 may detect a negative limit of the current. The output of the comparator comprising the first comparator 140 and second comparator 142, pins 1 and 7, form a wired OR gate pulled high through the eighth resistor 118. If either the positive or negative limit of the current is exceeded, then the output at the connection of pin 1 of the first comparator and pin 7 of the second comparator will become low, indicating an active load. This may turn the p-channel MOSFET 150 "on," which in turn will drive the second gate 74 of the second FET 70. At this point, the first FET 60 and second FET 70 of the hall-effect load status indicator may operate in a similar manner to the first FET 60 and second FET 70 of the reed switch load status indicator, as described above.

Figure 16:
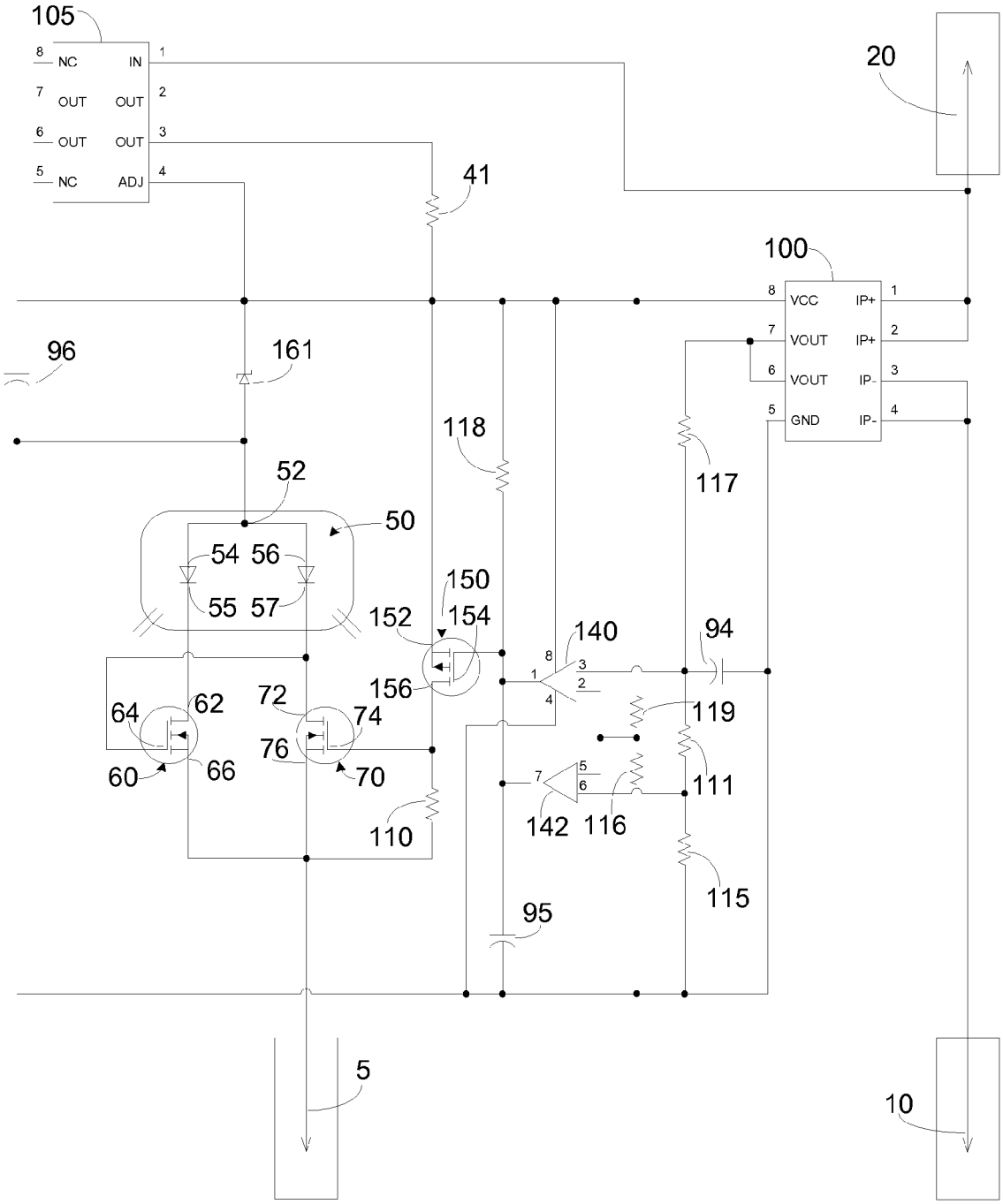
FIG. 16 shows a circuit diagram of an embodiment of a load status indicator utilizing a hall-effect linear sensor, three wires, operating on DC, with no remote indicator, and non-isolated.
Figure 17:
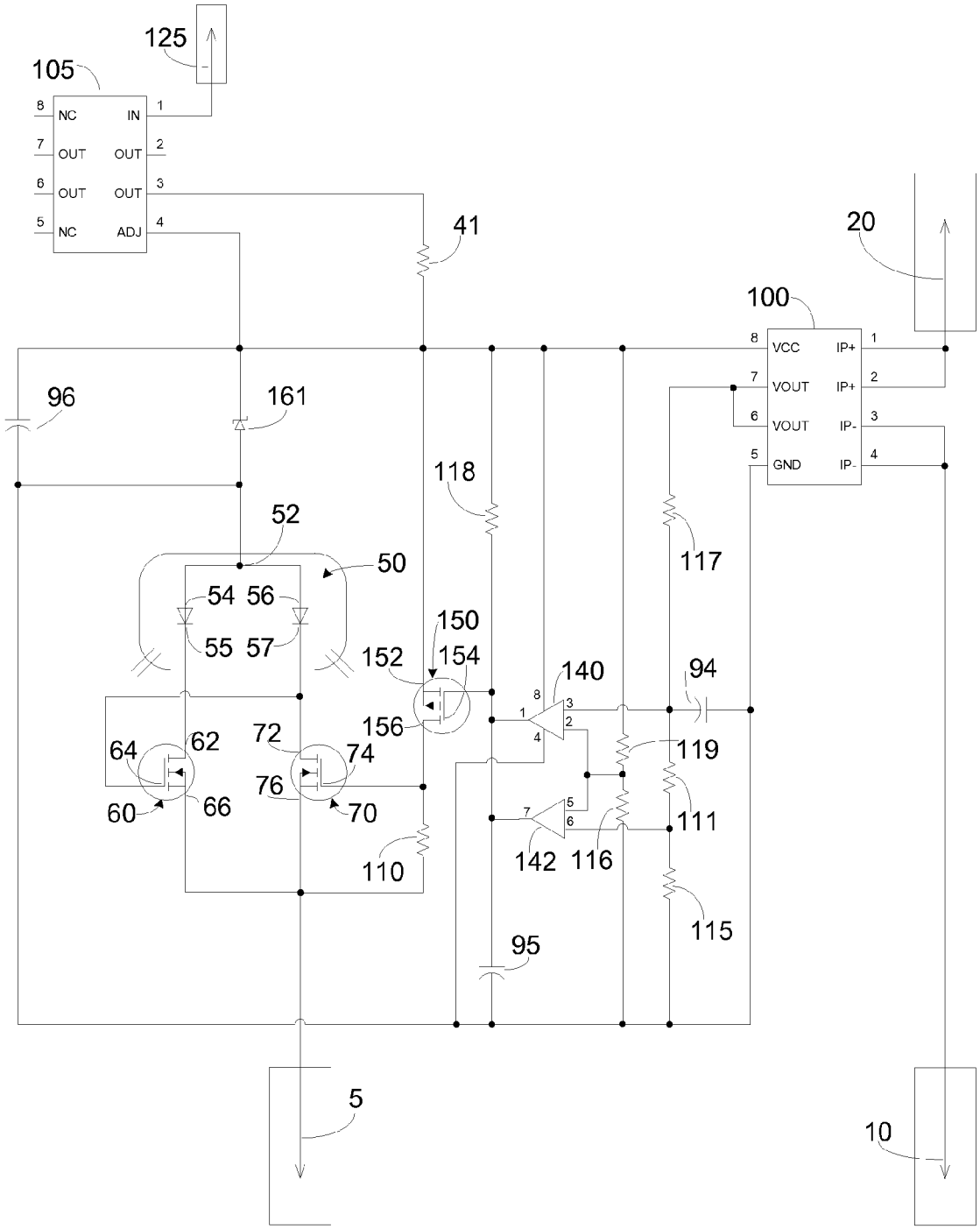
FIG. 17 shows a circuit diagram of an embodiment of a load status indicator utilizing a hall-effect linear sensor, four wires, operating on DC, with no remote indicator, and 800 volts root mean square isolation.
Figure 18:
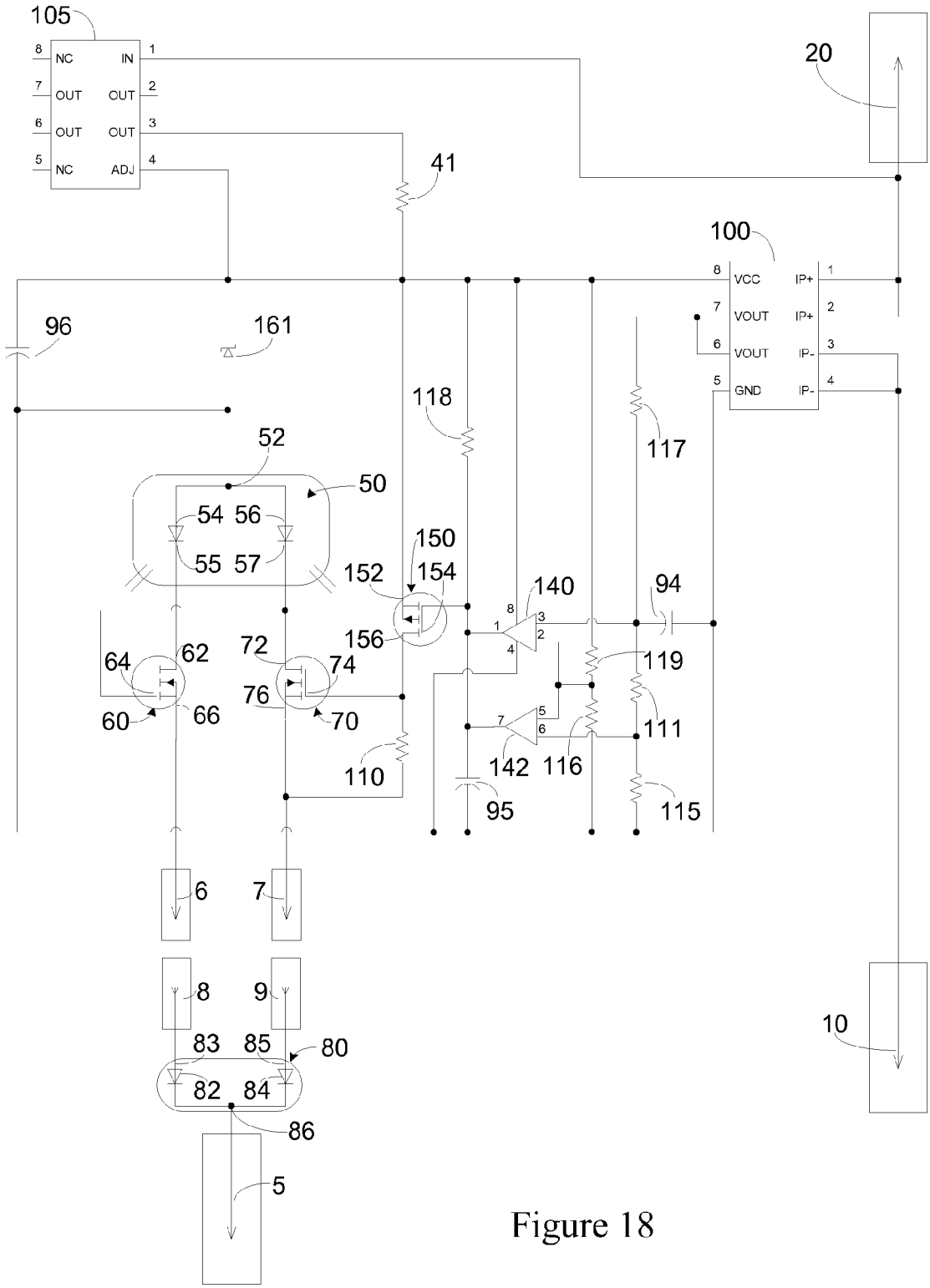
FIG. 18 shows a circuit diagram of an embodiment of a load status indicator utilizing a hall-effect linear sensor, four wires, operating on DC, with a remote indicator, and non-isolated.

FIGS. 16-19 show embodiments of the hall-effect load status indicator utilizing DC power, and correspond to the embodiments of the reed switch embodiments shown in FIGS. 4-7. In FIGS. 16 and 18, the independent current source 120 is replaced with the voltage regulator 105 and first resistor 41. Pin 3 of the voltage regulator 105 is connected to the first end of the first resistor 41. Pin 4 of the voltage regulator 105 and the second end of the first resistor 41 are connected to each other and to the second end of the sixth capacitor 96, to the cathode of the zener diode 161, to the source 152 of the p-channel MOSFET 150, to the first end of the eighth resistor 118, to pin 8 of the first comparator 140, and to the first end of the ninth resistor 119. Pin 1 of the voltage regulator 105 may be connected to the supply 20. In the embodiment shown in FIG. 16, the first source 66 of the first FET 60 and the second source 76 of the second FET 70 are connected to each other, to the first end of the tenth resistor 110, and to the negative supply 5. In the embodiment shown in FIG. 18, the first source 66 of the first FET 60 is connected to the red transmitter 6 which remotely communicates with the red receiver 8, which controls the red anode 83 of a second bi-color LED 80. Also in the embodiment shown in FIG. 18, the second source 76 of the second FET 70 is connected to the green transmitter 7 which remotely communicates with the green receiver 9, which controls a green anode 85 of the second bi-color LED 80.

Figure 19:
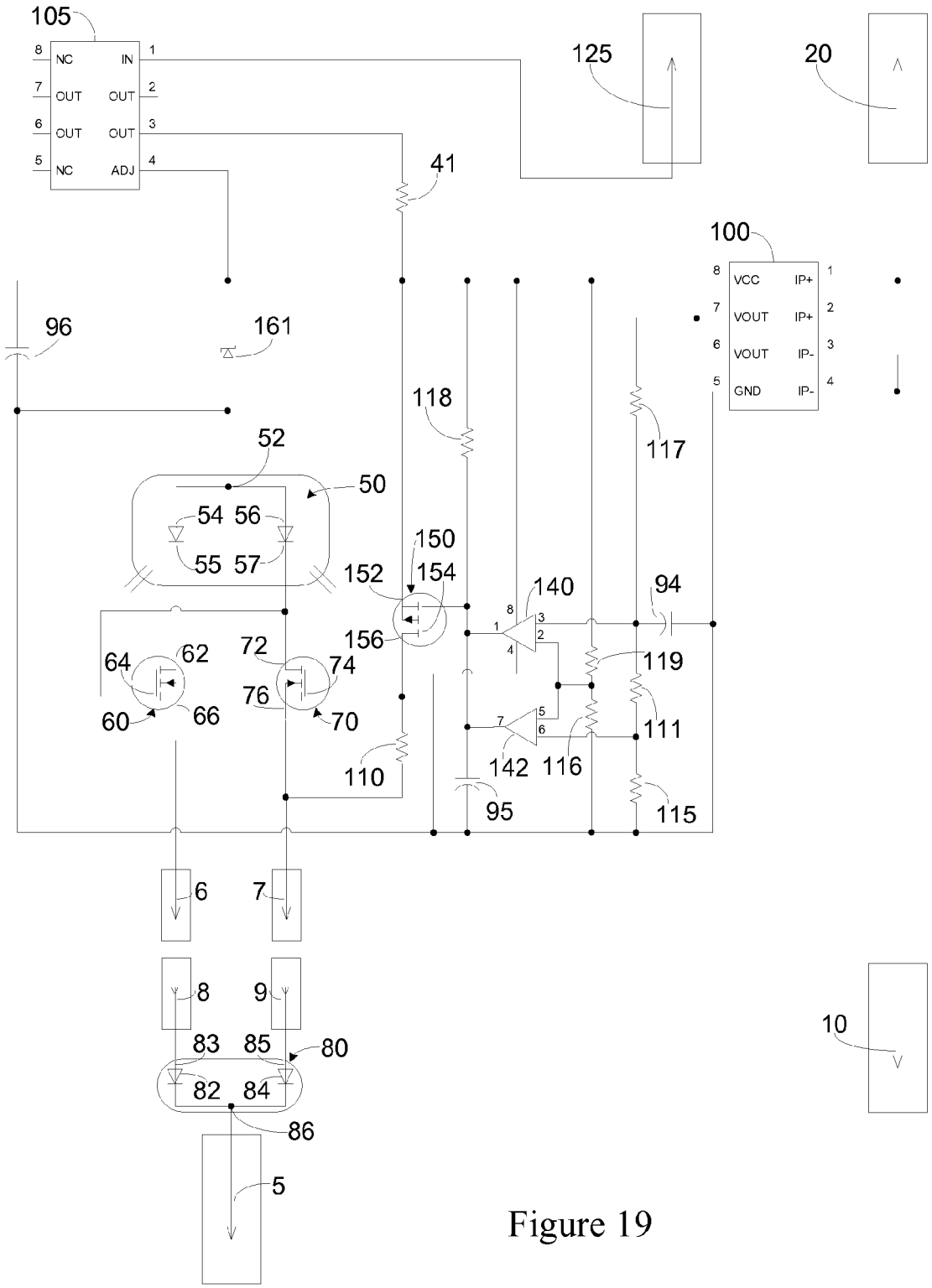
FIG. 19 shows a circuit diagram of an embodiment of a load status indicator utilizing a hall-effect linear sensor, five wires, operating on DC, with a remote indicator, and 800 volts root mean square isolation.

FIGS. 17 and 19 show embodiments of the load status indicator that are identical to the embodiments shown in FIGS. 16 and 18, respectively, except that pin 1 of the voltage regulator 105 is connected to a positive supply 125 instead of to the supply 20.

FIGS. 20-23 show embodiments of the load status indicator utilizing the hall-effect sensor 100 designed to operate on AC power. These embodiments utilize the AC supply circuit shown in FIG. 8. Each of the circuits shown in FIGS. 20-23 utilizes the voltage regulator 105. In each of these embodiments, pin 3 of the voltage regulator 105 is connected to the first end of the first resistor 41, and pin 4 of the voltage regulator 105 and the second end of the first resistor 41 are connected to each other and to the second end of the sixth capacitor 96, to the cathode of the zener diode 161, to the source 152 of the p-channel MOSFET 150, to the first end of the eighth resistor 118, to pin eight of the first comparator 140, and to the first end of the ninth resistor 119. Pin 1 of the voltage regulator 105 is connected to the DC OUTPUT of the circuit shown in FIG. 8.

Figure 20:
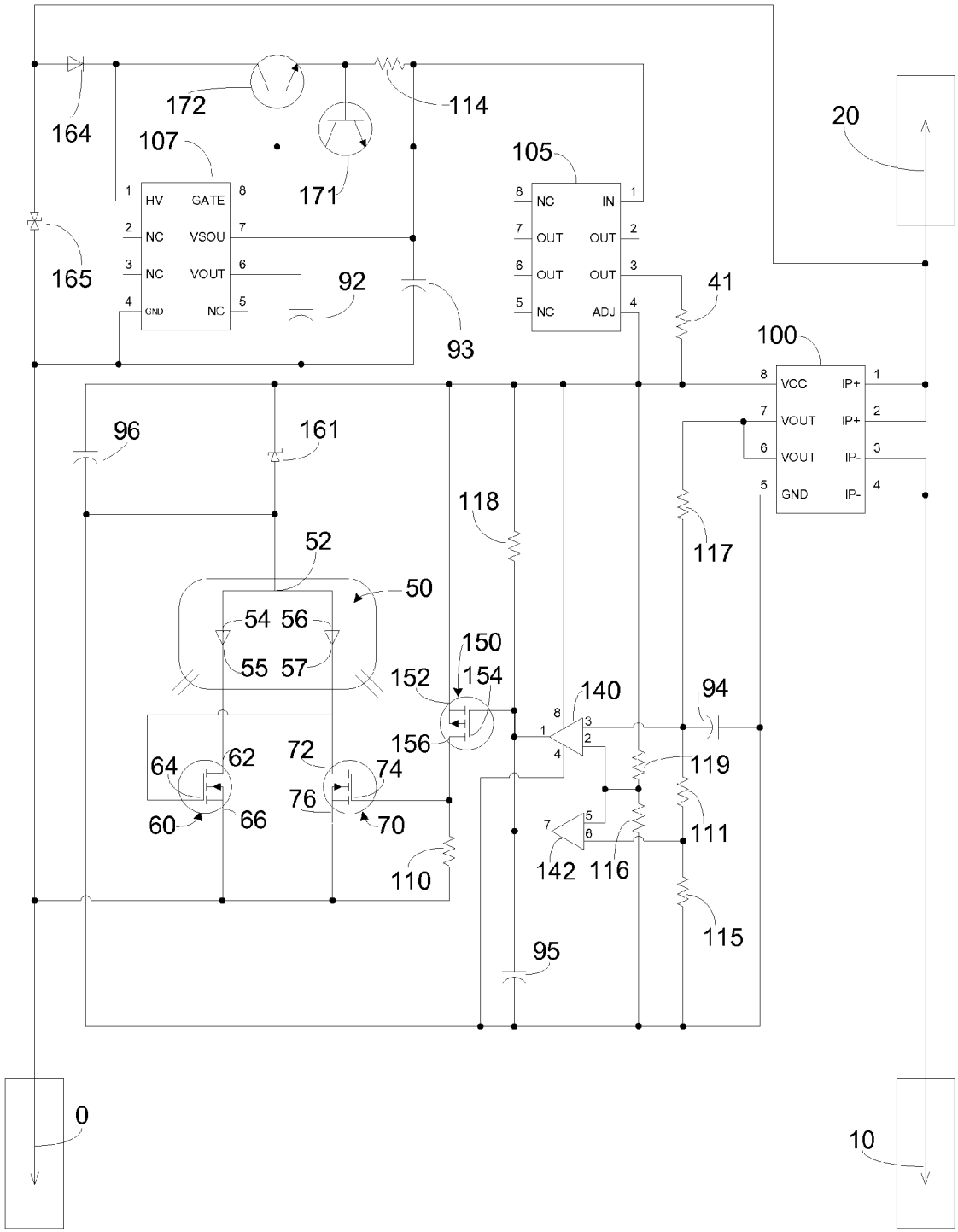
FIG. 20 shows a circuit diagram of an embodiment of a load status indicator utilizing a hall-effect linear sensor, three wires, operating on AC, with no remote indicator, and non-isolated.
Figure 21:
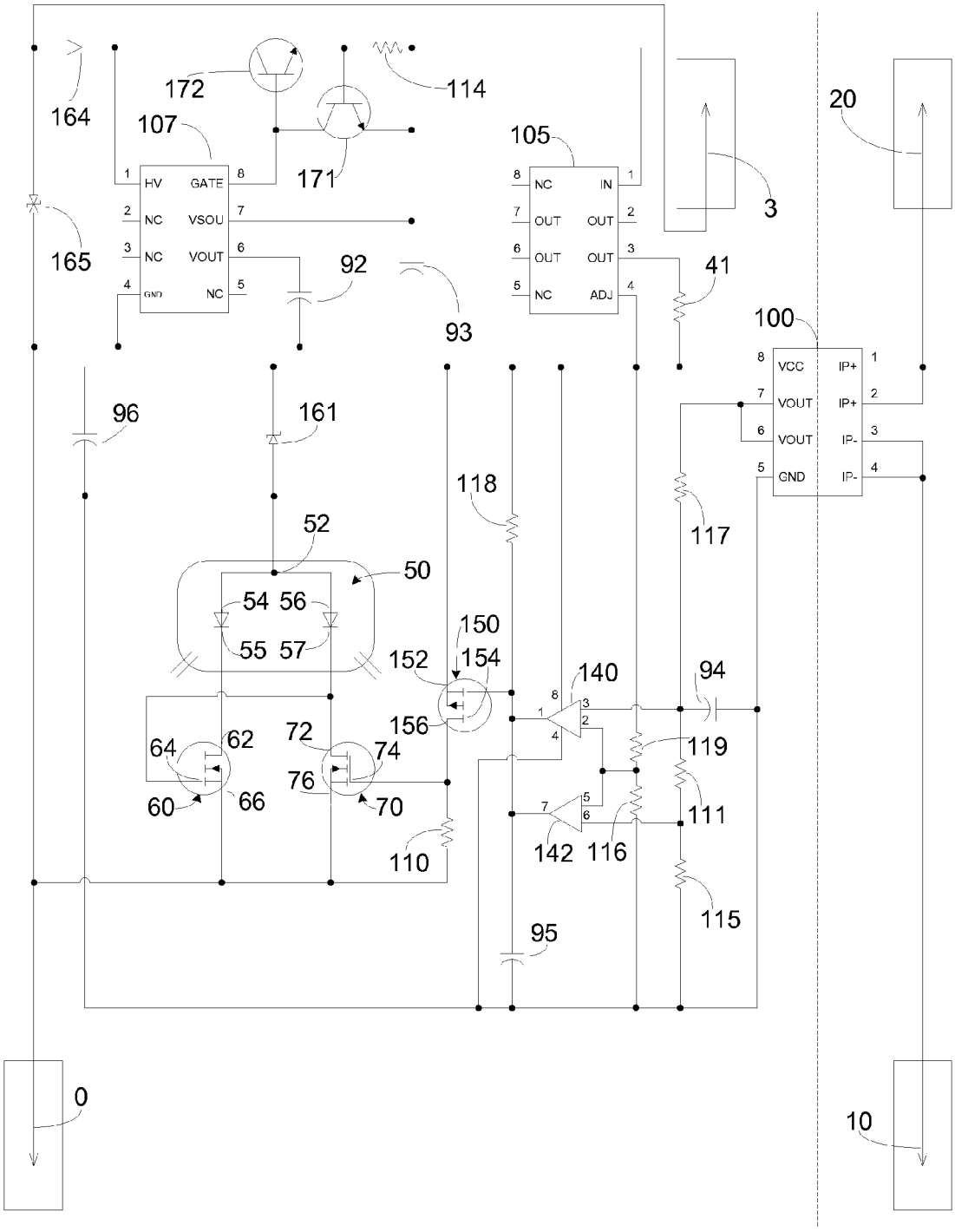
FIG. 21 shows a circuit diagram of an embodiment of a load status indicator utilizing a hall-effect linear sensor, three wires, operating on AC, with no remote indicator, and 800 volts root mean square isolation.
Figure 22:
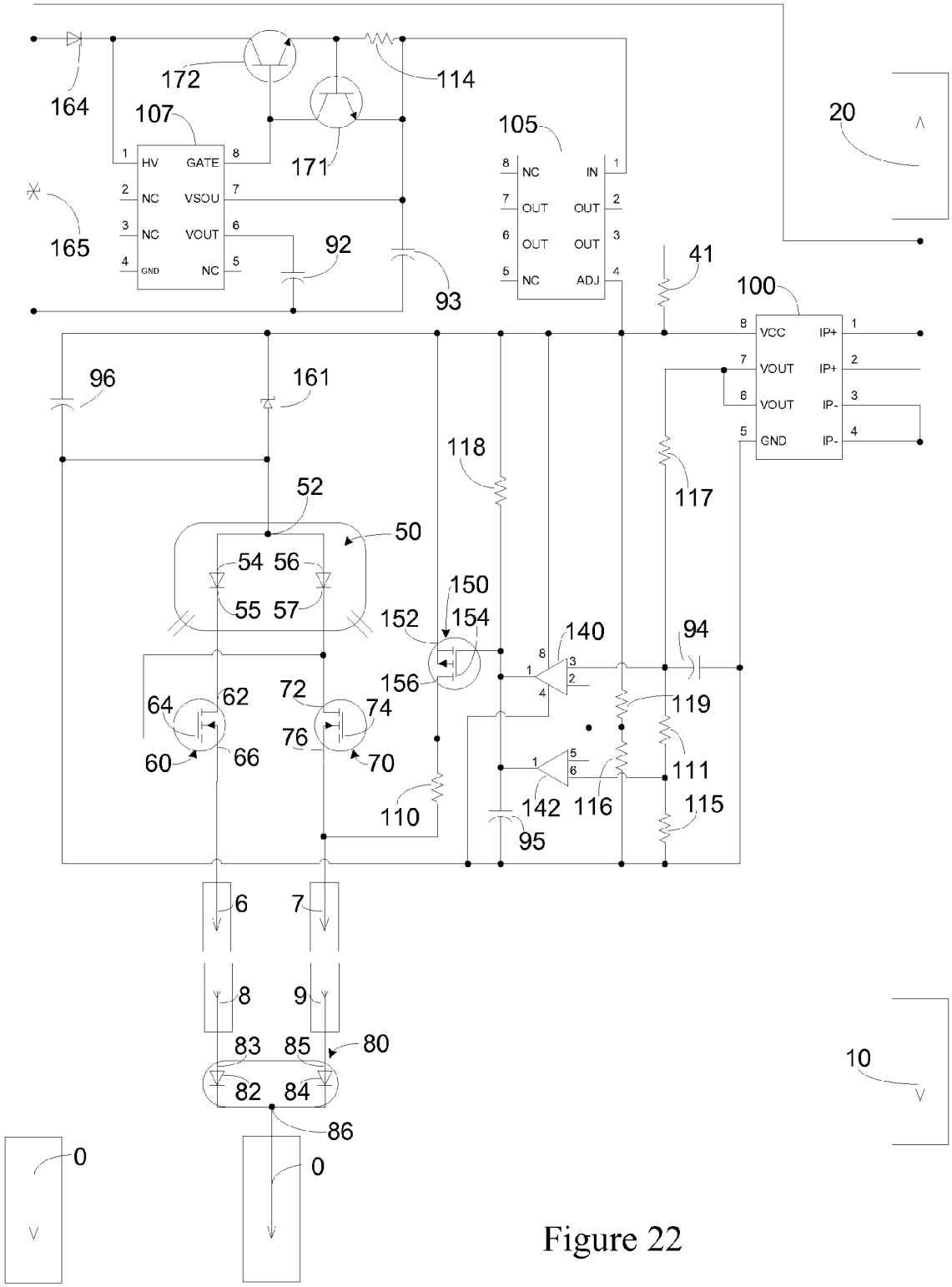
FIG. 22 shows a circuit diagram of an embodiment of a load status indicator utilizing a hall-effect linear sensor, five wires, operating on AC, with a remote indicator, and non-isolated.
Figure 23:
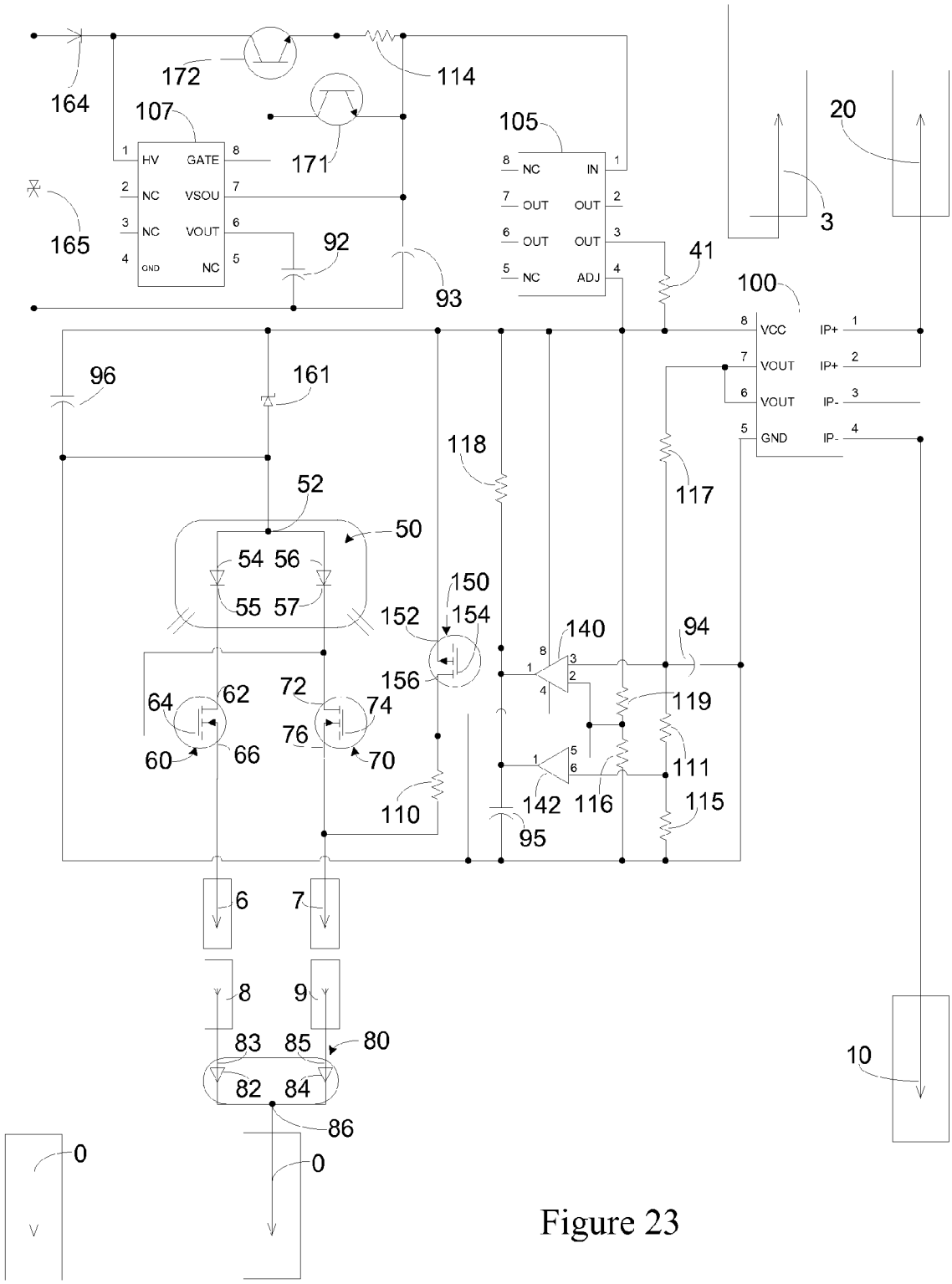
FIG. 23 shows a circuit diagram of an embodiment of a load status indicator utilizing a hall-effect linear sensor, six wires, operating on AC, with a remote indicator, and 800 volts root mean square isolation.
Figure 24:
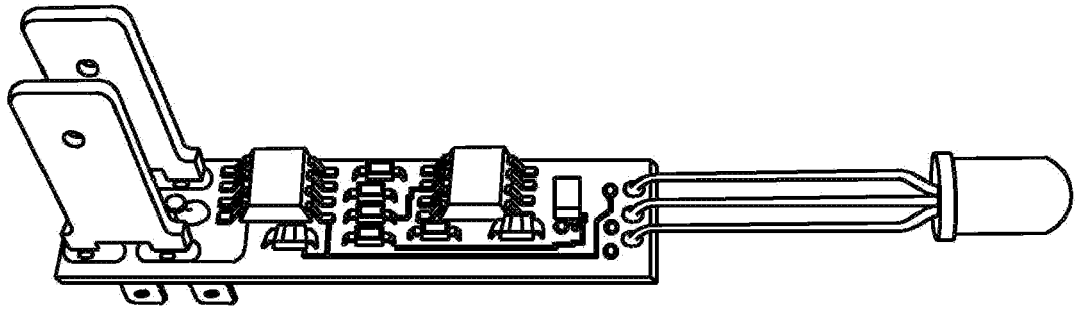
FIG. 24 shows a physical embodiment of a load status indicator using a hall-effect linear sensor, operating on DC, using surface mount components.
Figure 25:
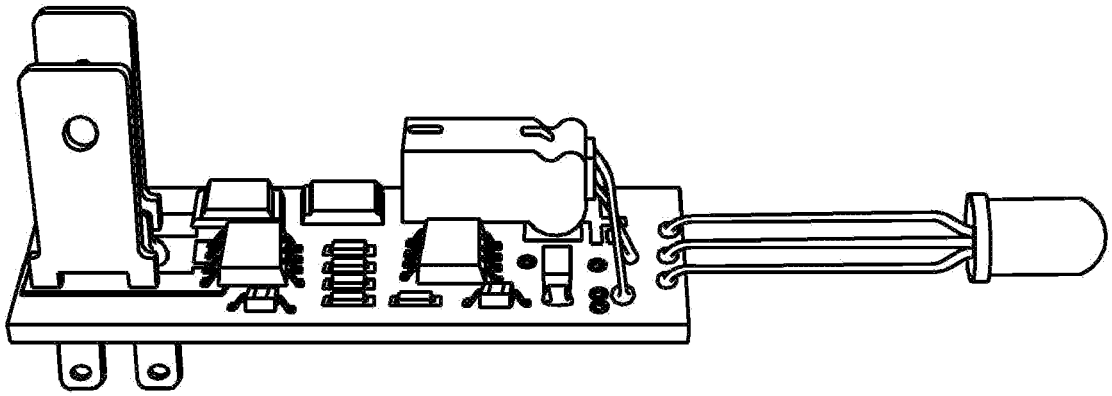
FIG. 25 shows a physical embodiment of a load status indicator using a hall-effect linear sensor, operating on AC, using surface mount components.
Figure 26:
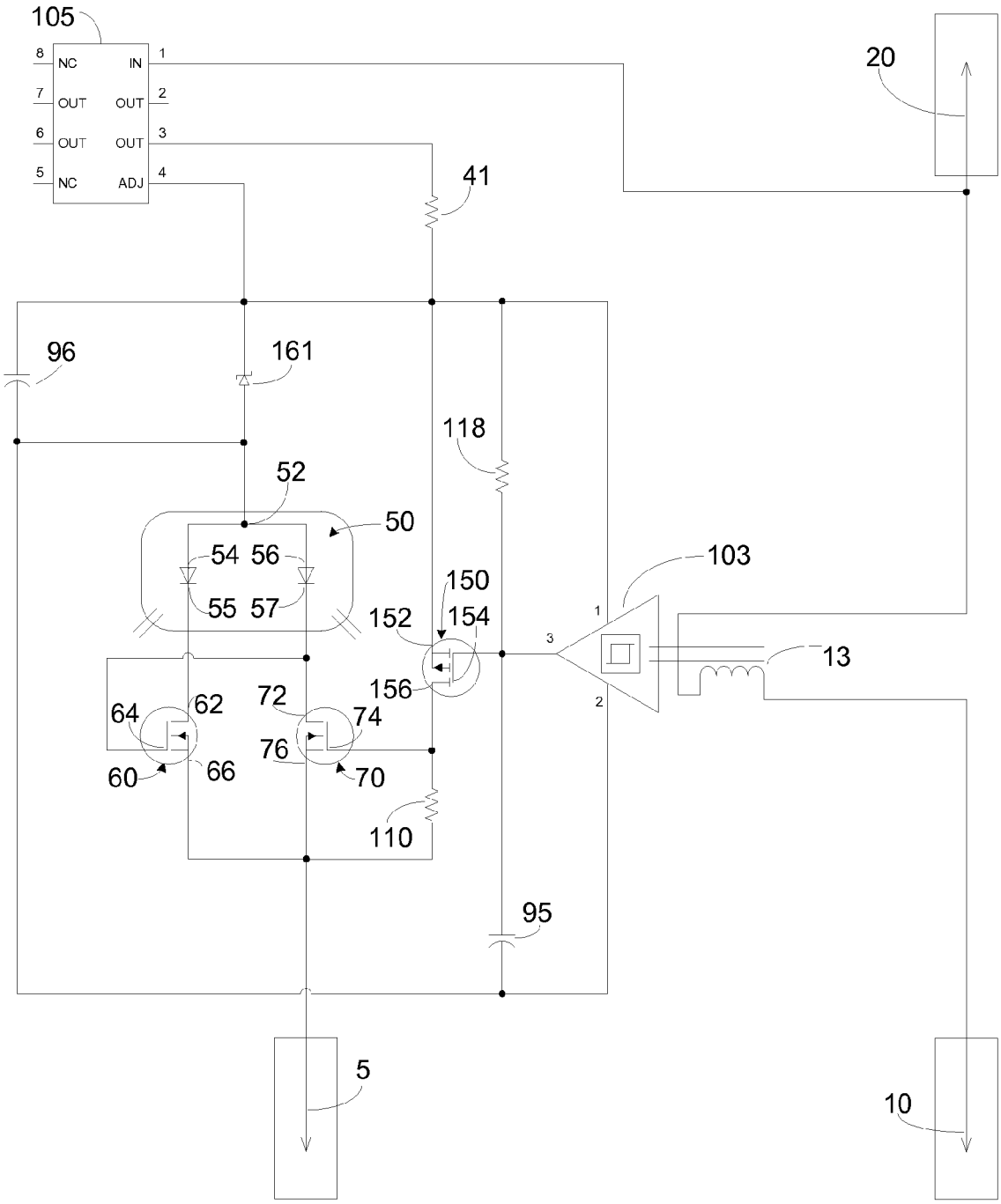
FIG. 26 shows a circuit diagram of an embodiment of a load status indicator utilizing a hall-effect switch, three wires, operating on DC, with no remote indicator, and non-isolated.
Figure 27:
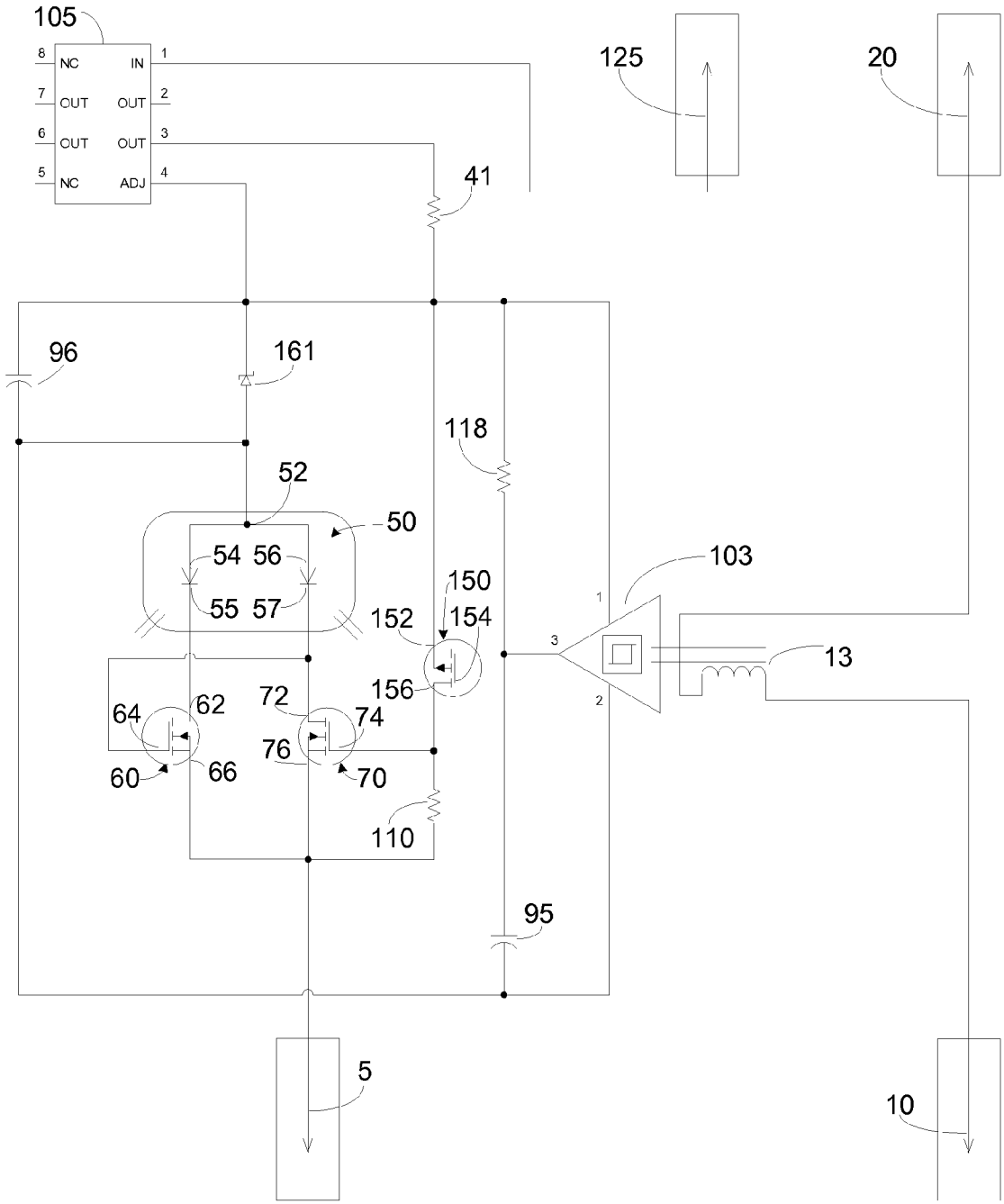
FIG. 27 shows a circuit diagram of an embodiment of a load status indicator utilizing a hall-effect switch, four wires, operating on DC, with no remote indicator, and 2,500 volts root mean square isolation.
Figure 28:
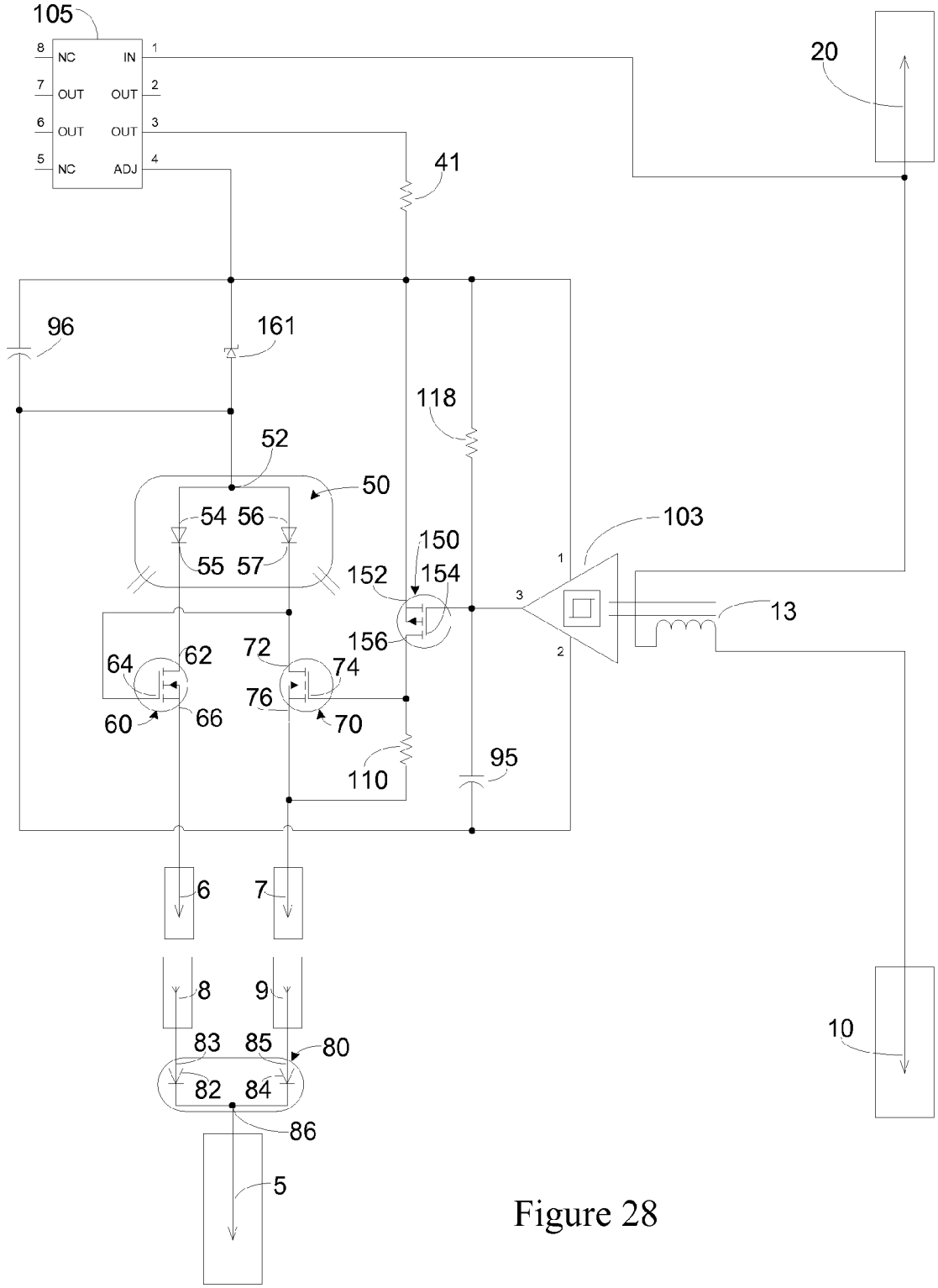
FIG. 28 shows a circuit diagram of an embodiment of a load status indicator utilizing a hall-effect switch, four wires, operating on DC, with a remote indicator, and non-isolated.
Figure 29:
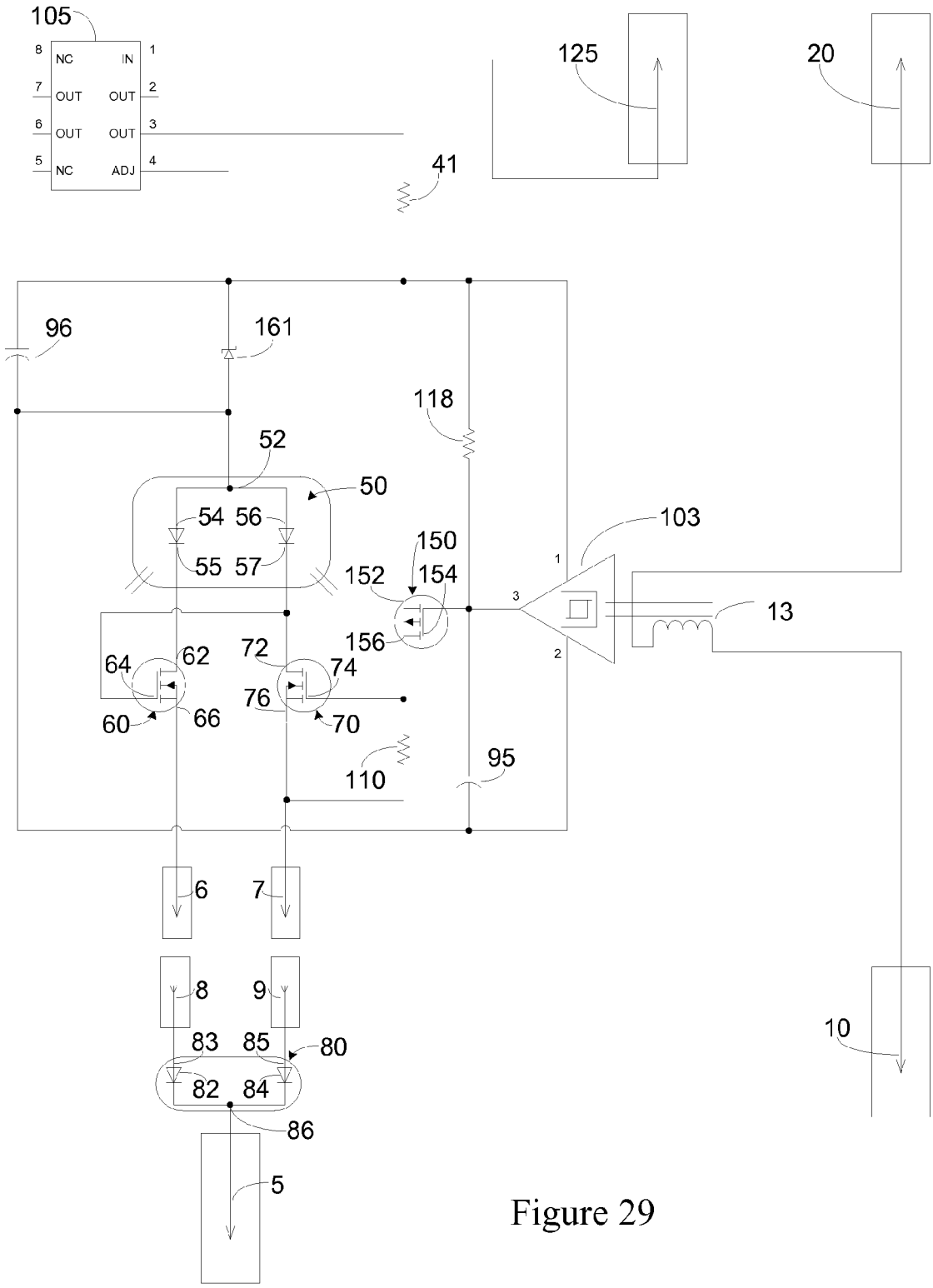
FIG. 29 shows a circuit diagram of an embodiment of a load status indicator utilizing a hall-effect switch, five wires, operating on DC, with a remote indicator, and 2,500 volts root mean square isolation.
Figure 30A:
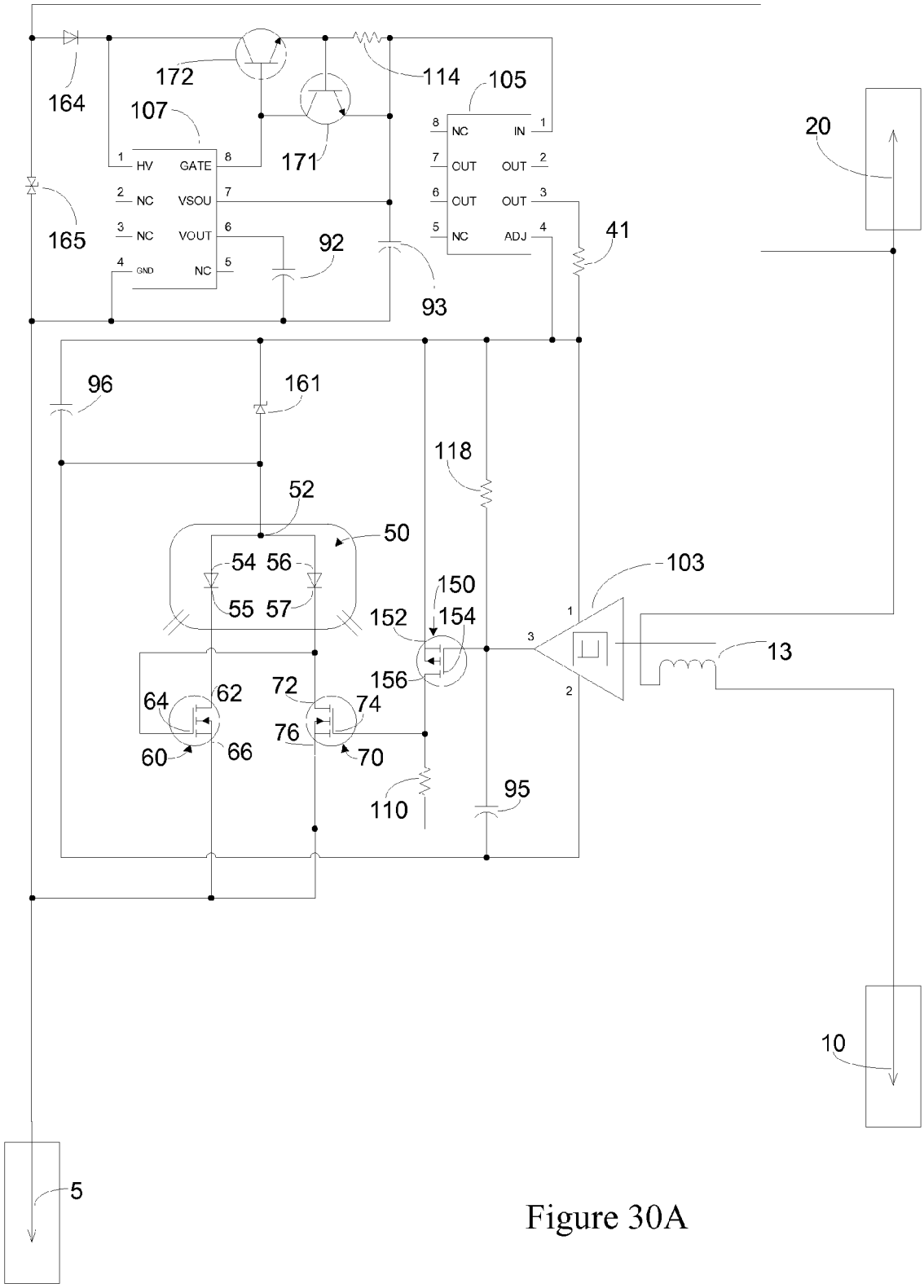
FIG. 30A shows a circuit diagram of a load status indicator utilizing a hall-effect switch, operating on either AC or DC, with no remote indicator, and non-isolated.
Figure 30B:
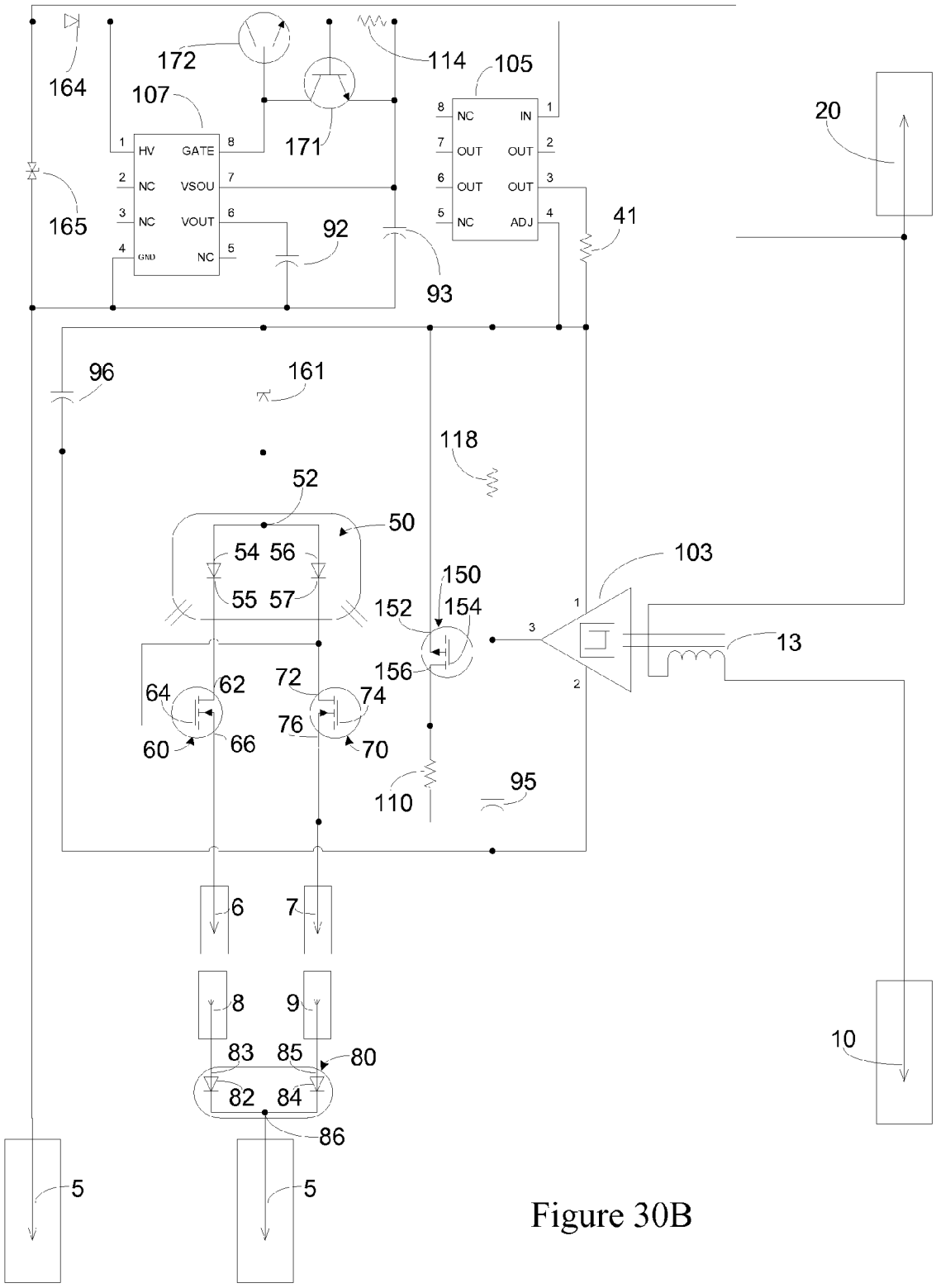
FIG. 30B shows a circuit diagram of an embodiment of a load status indicator utilizing a hall-effect switch, operating on either AC or DC, with a remote indicator, and non-isolated.
Figure 31:
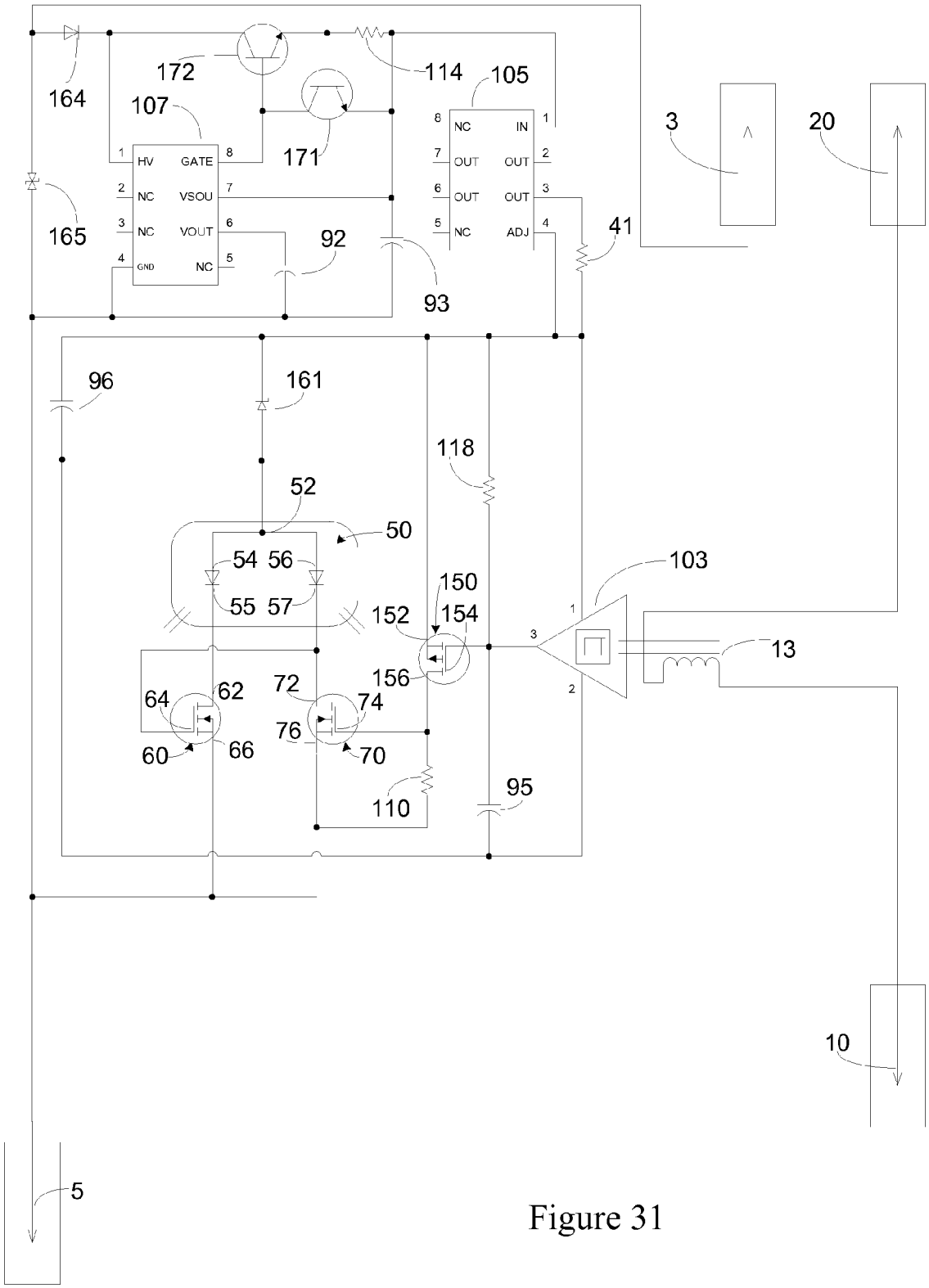
FIG. 31 shows a circuit diagram of an embodiment of a load status indicator utilizing a hall-effect switch, operating on either AC or DC, with no remote indicator, and 2,500 volts root mean square isolation.
Figure 32:
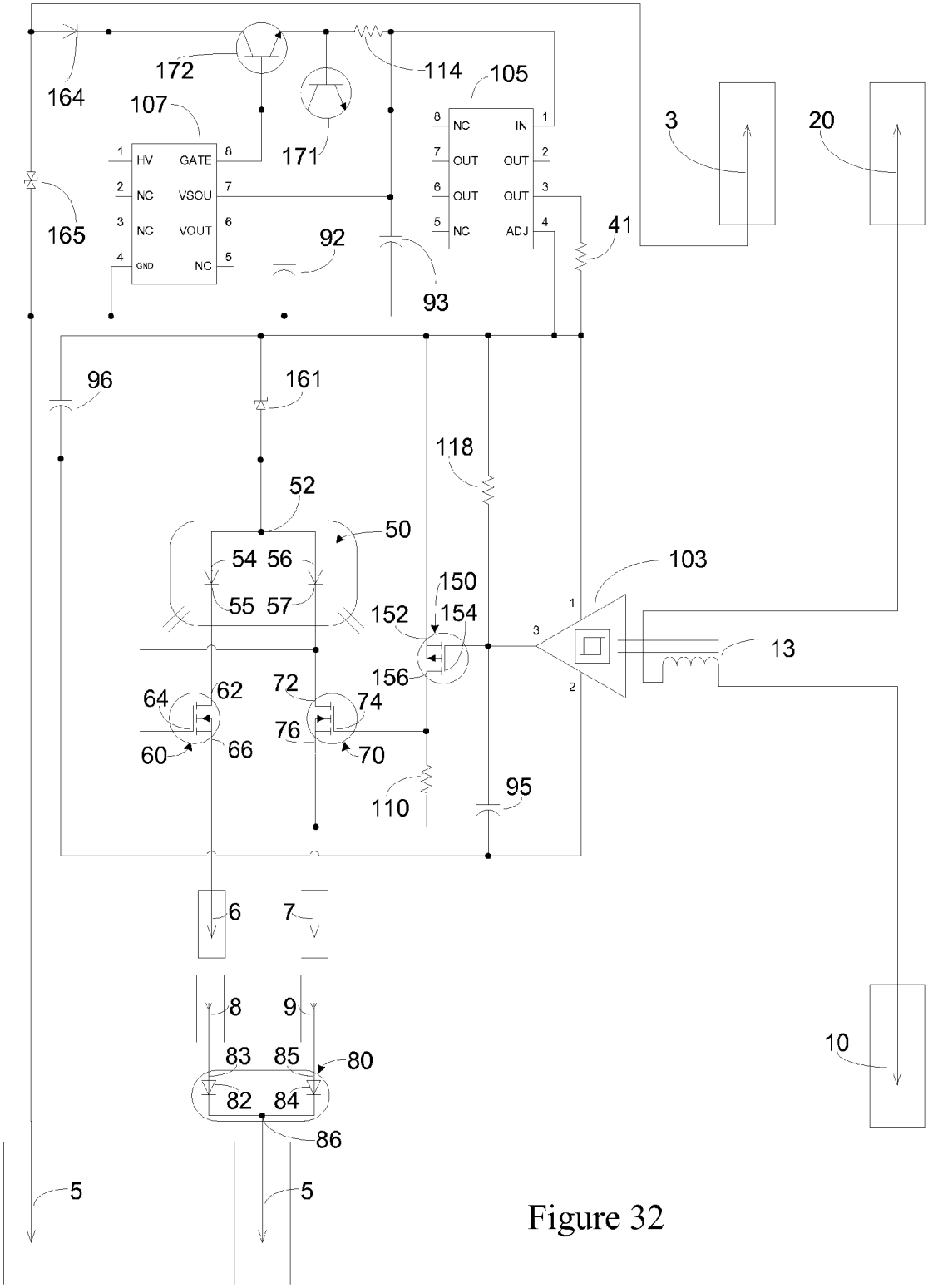
FIG. 32 shows a circuit diagram of an embodiment of a load status indicator utilizing a hall-effect switch, operating on either AC or DC, with a remote indicator, and 2,500 volts root mean square isolation.

In the embodiments shown in FIGS. 20 and 22, the anode of the second diode 164 and the first end of the surge protector 165 are connected to the supply 20, whereas in the embodiments shown in FIGS. 21 and 23, the anode of the second diode 164 and the first end of the surge protector 165 are connected to the AC input 3.

Choice of Resistor Values in Hall-Effect Sensor Embodiments

The choice of resistor values may be used to determine the minimum current, I, which must flow through the load 10 for the bi-color LED 50 to indicate that the load 10 is operating. A positive set point and a negative set point, $V_{pos}$ and $V_{neg}$, respectively, may be determined as functions of the voltage regulation of the zener diode 140 (5.1 volts in the embodiments described herein) and of the desired minimum current/through the load 10:

$$V\text{pos}=5.1/2+0.133\times I$$

$$V\text{neg}=5.1/2-0.133\times I$$

A reference voltage, $V_{ref}$, may be established as a function of the voltage regulation of the zener diode 140, and of the values of the sixth resistor 116 (R6) and ninth resistor 119 (R9):

$$Vref = 5.1\left(\frac{R6}{R6 + R9}\right)$$

$$R9 = 10.0\ \text{K}$$

$$R6 = 1.0\ \text{K}$$

Therefore:

$$Vref = .4545$$

From $V_{pos}$, $V_{neg}$, $V_{ref}$, and the value of the seventh resistor 117 (R7), the values of the eleventh resistor 111 (R11) and fifth resistor 115 (R5) may be determined:

$$R7 = 10.0\ \text{K}$$

$$R11 = R7 \times \frac{Vref(Vpos - Vneg)}{Vpos(Vneg - Vref)}$$

$$R5 = \frac{Vref(R7 + R11)}{Vpos - Vref}$$

By changing the values of the eleventh resistor 111 and fifth resistor 115, the minimum current/may be set to any desired value.

Hall-Effect Switch Embodiments

The load status indicator may also use a hall-effect switch 103 instead of a hall-effect sensor 100 or reed switch 14, as shown in FIGS. 26-32. In some embodiments, the hall-effect switch 103 comprises an A3212 integrated circuit manufactured by Allegro. This integrated circuit comprises a hall-effect switch coil 13 which couples a magnetic field to the hall-effect switch 103 using a high permeability ferrite core of 2,300 gauss or greater. This ferrite core concentrates the magnetic field of the hall-effect switch coil 13, enabling current sensing as low as five hundred milliamperes. The current threshold for the hall-effect switch 103 may be adjusted by changing the distance of the ferrite core from the sensor: the closer the ferrite core is to the sensor, the lower the current threshold.

These A3212 embodiments operate at a voltage level between 2.5 volts and 3.5 volts, and utilize a unique clocking scheme, which reduce the average operating power requirements to less than fifteen microwatts with a 2.75 volt supply. Either a north or south pole of sufficient strength will turn the output on in these embodiments, and in the absence of a magnetic field, the output is off. In some embodiments, fifty gauss in either polarity is required to cause the hall-effect switch 103 to trigger states. The voltage at pin 3 of the hall-effect switch 103 will be zero or ground when the flux field caused by current flowing through the hall-effect switch coil 13 is greater than fifty gauss, and will be equal to the voltage at pin 1 of the hall-effect switch when the flux field is below fifty gauss, with a hysteresis of ten gauss.

The embodiments utilizing the hall-effect switch 103 shown in FIGS. 26, 27, 28, 29, 30A, 30B, 31, and 32, correspond to the embodiments utilizing the hall-effect sensor 100 shown in FIGS. 16, 17, 18, 19, 20, 22, 21, and 23, respectively. In the embodiments utilizing the hall-effect switch 103, the hall-effect switch 103, of which the hall-effect switch coil 13 is a part, replaces the hall-effect sensor 100, the first comparator 140 and second comparator 142, the fifth resistor 115, the sixth resistor 116, the seventh resistor 117, the ninth resistor 119, the eleventh resistor 111, and the fourth capacitor 94. In the embodiments shown in FIGS. 27, 29, 31, and 32, there are 2,500 volts root mean square of isolation between the supply 20 and load 10, and the rest of the circuit.

In the embodiments shown in FIGS. 26-32, current flows from the supply 20, through the hall-effect switch coil 13, to the load 10. Pin 1 of the hall-effect switch 103 is connected to the second end of the first resistor 41, to pin 4 of the voltage regulator 105, to the second end of the sixth capacitor 96, to the cathode of the zener diode 161, to the source 152 of the p-channel MOSFET 150, and to the first end of the eighth resistor 118. Pin 2 of the hall-effect switch 103 is connected to the first end of the fifth capacitor 95, to the first end of the sixth capacitor 96, to the anode of the zener diode 161, and to the anode 52 of the first bi-color LED 50. Pin 3 of the hall-effect switch 103 is connected to the second end of the eighth resistor 118, to the gate 154 of the p-channel MOSFET 150, and to the second end of the fifth capacitor 95. When sensing AC current, as in FIGS. 30-32, the hall-effect switch 103 utilizes the eighth resistor 118 and fifth capacitor 95 to form a low-pass filter which stabilizes the voltage level at pin 3 of the hall-effect switch 103.

The hall-effect switch 103 shares the advantage of the hall-effect sensor 100 in that it is easier to manufacture in large quantities than embodiments utilizing the reed switch 14. Embodiments utilizing the hall-effect switch 103 have advantages that the cost of the hall-effect switch 103 is comparable to a reed switch 14 and less than a hall-effect sensor 100, and the design complexity for the hall-effect switch 103 is far less than that for the hall-effect sensor 100. The polarity independence and minimal power requirement of the hall-effect switch 303 utilizing the A3212 integrated circuit allows it to replace the reed switch 14 for superior reliability and ease of manufacturing, while eliminating the requirement for signal conditioning. Further advantages of embodiments utilizing the hall-effect switch 103 instead of the reed switch 14 or hall-effect sensor 100 are that the hall-effect switch 103 is more robust, operates over a greater temperature range, is capable of an infinite number of trigger cycles, is capable of surviving very high current surges, and has the greatest isolation voltages.

Applications of the Load Status Indicator

The load status indicator could also utilize multiple indicators. With a twelve-volt source, the voltage drop from the supply 20 through the first diode 40 or the zener diode 161, the first bi-color LED 50, and either the first FET 60 or the second FET 70, to the first source 66 or to the second source 76, is approximately 5.5 volts, with 6.5 volts available to power additional LEDs. With a typical LED having a voltage drop of approximately 2.2 volts at 20 milliamperes of current, three such bi-color LEDs could be connected in series for remote indication of the status of the load 10. Opto relays could also be connected in series with the load status indicator and bi-color LEDs to generate signals for processing by other systems.

One application of the present invention is to a bilge pump of a boat. The load status indicator may indicate red whenever the pump is running and drawing current, confirming proper operation of both the pump and the float; the load status indicator may indicate green when power is available but there is a failure in or near the pump. The components remotely indicating the status of the load can be connected to the source of each of the two FETs. In this application, the load status indicator would be installed in the power distribution panel and the remote indicators would be installed in the navigation center. The load status indicator could also be used to monitor all essential and nonessential loads on a boat in order to maintain good electrical power management.

Another application of the present invention is monitoring whether a control element, such as a solenoid, motor, pump, or compress is running. The load status indicator would indicate whether the element was on and drawing current.

Another application of the present invention is on a motor home in which propane is used for cooking or heating. The load status indicator could be used to indicate the true status of the safety solenoid. A switch could be used to turn on the flow of propane whenever there is a need to heat or cook. The load status indicator would indicate whether power was available and whether the solenoid was actually energized. If the switch were on and the load status indicator indicated green but not red, then this would indicate that the solenoid was defective and needed to be replaced. The load status indicator could also be used to confirm that a carbon monoxide detector was receiving power for operation and did not have an internally blown fuse. If the load status indicator were indicating red, then the carbon monoxide detector would be drawing current, and the fuse must be functional.

Because the first and second FETs 60, 70 may lead to ground, neutral, or negative supplies, possibly through remote status indicators, and the load 10 may lead to ground or neutral, all of the components of the load status indicator except the coil 12 or hall-effect linear sensor 100 may be considered to be connected in parallel with the series of coil 12 or hall-effect linear sensor 100 and load 10. Thus, the indicating circuit may be connected in parallel with the series of coil 12 and load 10. This parallel connection may allow the load status indicator to function without reducing the power available to the load 10 when the load 10 is powered by a voltage source. Because all of the components except the coil 12 or hall-effect linear sensor 100 are either in parallel with the load 10 or independently powered, rather than in series with the load 10, those components do not reduce the power available to the load 10. The only component connected in series with the load 10, the coil 12 or hall-effect sensor 100, draws only a small amount of power from the load 10, typically less than one watt at the maximum design load of thirty amperes. Thus, the load status indicator herein described enables one to continuously monitor the load 10 without reducing the power available to the load 10. Because the load status indicator herein described causes one visual status indicator, but not the other, to light up depending on whether the load 10 is drawing current, the load status indicator enables use of bi-color light-emitting diodes to clearly show one of three states (no color for no power available, green for power available but not in use, or red for power available and in use) with a single lens package. Colors other than red and green could be used for the LEDs.

Although this invention has been described in terms of certain preferred embodiments, other embodiments that are apparent to those of ordinary skill in the art, including embodiments that do not provide all of the features and advantages set forth herein, are also within the scope of this invention. Rather, the scope of the present invention is defined only by reference to the appended claims and equivalents thereof.

What is claimed is:

1. A load status indicator comprising:

a first visual status indicator configured to indicate when power is available to a load but current is not flowing through the load; and a second visual status indicator configured to indicate when power is available to the load and current is flowing through the load;

wherein the visual status indicators are not connected in series with the load; and wherein a threshold current is determined by a ratio of two resistors.

2. The load status indicator of claim 1 further comprising:

a first field-effect transistor and a second field-effect transistor;

wherein a drain-source channel of the first field-effect transistor is connected in series with the first visual status indicator; and the second visual status indicator is connected to a terminal of the second field-effect transistor, the terminal being selected from the group consisting of a drain and a source.

3. The load status indicator of claim 2 wherein a bi-color light-emitting diode comprises the first and second visual status indicators.

4. The load status indicator of claim 3 wherein a hall-effect sensor is connected in series with a power source and the load.

5. The load status indicator of claim 1 wherein:

the two resistors comprise a first resistor and a second resistor;

the first resistor is connected to a first input of a first comparator and to a first input of a second comparator; and the second resistor is connected to a second input of the first comparator and to a second input of the second comparator.

6. A load status indicator comprising:

a current-sensing component connected in series with a load;

an indicating circuit connected in parallel with the series of load and current-sensing component, the indicating circuit comprising:

a first visual status indicator configured to turn on when power is available to the load and indicating circuit, but a threshold current is not flowing through the current-sensing component, and to turn off when the threshold current is flowing through the current-sensing component; wherein the threshold current is determined by a ratio of two resistors; and a second visual status indicator configured to turn on when power is available to the load and indicating circuit, and the threshold current is flowing through the current-sensing component, and to turn off when the threshold current is not flowing through the current-sensing component.

7. The load status indicator of claim 6 wherein the indicating circuit farther comprises:

a first transistor configured to control whether current can flow through the first visual status indicator; and a second transistor configured to control whether current can flow through the second visual status indicator.

8. The load status indicator of claim 7 wherein a bi-color light-emitting diode comprises the first and second visual status indicator.

9. The load status indicator of claim 8 wherein the current-sensing component comprises a hall-effect sensor.

10. The load status indicator of claim 9 wherein:

the two resistors comprise a first resistor and a second resistor;

the first resistor is connected to a first input of a first comparator and to a first input of a second comparator; and the second resistor is connected to a second input of the first comparator and to a second input of the second comparator.

11. The load status indicator of claim 6 wherein the current-sensing component comprises a hall-effect sensor.

12. The load status indicator of claim 11 wherein the threshold current is determined by the ratio of two resistors.

13. The load status indicator of claim 12 wherein:

the two resistors comprise a first resistor and a second resistor;

the first resistor is connected to a first input of a first comparator and to a first input of a second comparator; and the second resistor is connected to a second input of the first comparator and to a second input of the second comparator.

14. A load status indicator comprising:

a current-sensing component;

a first transistor and a second transistor;

a first visual status indicator and a second visual status indicator;

wherein the load status indicator is configured to bias the first transistor to high impedance and to bias the second transistor to low impedance when a threshold current is not flowing through the current-sensing component;

wherein the load status indicator is configured to bias the first transistor to low impedance and to bias the second transistor to high impedance when the threshold current is flowing through the current-sensing component;

wherein the load status indicator is configured to cause the first visual status indicator to turn on when the first transistor is biased to low impedance; and wherein the load status indicator is configured to cause the second visual status indicator to turn on when the second transistor is biased to low impedance.

15. The load status indicator of claim 14 wherein:

the current-sensing component is a hall-effect sensor.

16. The load status indicator of claim 15 further comprising:

a first resistor, a second resistor, and a third resistor;

wherein the hall-effect linear sensor comprises an output terminal and a ground terminal;

wherein the first resistor, second resistor, and third resistor are connected in series between the output terminal and the ground terminal; and wherein the threshold current is determined by a ratio between the second resistor and the third resistor.

17. The load status indicator of claim 16 further comprising:

a first comparator and a second comparator;

wherein an input of the first comparator is connected to a node at which the first resistor and second resistor are connected to each other; and wherein an input of the second comparator is connected to a node at which the second resistor and third resistor are connected to each other.

18. The load status indicator of claim 17 further comprising:

a third transistor;

wherein the output of the first comparator and the output of the second comparator are connected to the third transistor;

wherein a voltage potential of the output of the third transistor determines whether the first transistor and second transistor are biased high or low.

* * * * *